United States Patent [19]

Verslycken

[11] Patent Number: 4,652,862

[45] Date of Patent: Mar. 24, 1987

[54] SURVEILLANCE AND CONTROL SYSTEM FOR EMERGENCY EXISTS INSTALLED IN A BUILDING

[75] Inventor: Alain R. Verslycken, St. Martin, France

[73] Assignee: Constructions Electroniques De La Ferte Sous Jouarre, France

[21] Appl. No.: 708,086

[22] Filed: Mar. 5, 1985

[30] Foreign Application Priority Data

Mar. 6, 1984 [FR] France ..... 84 03448
Aug. 7, 1984 [FR] France ..... 84 12459

[51] Int. Cl.[4] ..... G08B 21/00; E05B 45/06

[52] U.S. Cl. ..... 340/540; 340/542; 340/527; 340/528; 340/309.15; 340/825.31; 340/505; 340/825.06; 109/21; 109/38; 109/43; 49/14; 49/30; 49/31; 49/279; 358/108; 292/92; 70/92; 70/263; 70/267; 70/270

[58] Field of Search ..... 340/540, 541, 542, 506, 340/505, 525, 309.15, 825.31, 825.32, 825.33, 825.34, 543, 825.06, 527, 825.75, 528; 109/6–8, 21, 21.5, 38, 43, 44; 49/13–15, 24, 29, 30, 31, 32, 279; 358/108, 109; 70/91, 92, 262–264, 267–270, DIG. 49; 292/92, DIG. 25

[56] References Cited

U.S. PATENT DOCUMENTS 3,701,100 10/1972 Yarbrough ..... 340/825.31
4,037,250 7/1977 McGahan et al. ..... 358/108
4,461,221 7/1984 Schandle et al. ..... 109/6
4,581,634 4/1986 Williams ..... 358/108

FOREIGN PATENT DOCUMENTS 0065418 11/1982 European Pat. Off. ..... 70/92

*Primary Examiner*—Donnie L. Crosland
*Attorney, Agent, or Firm*—Laff, Whitesel, Conte & Saret

[57] ABSTRACT

A building has at least one security guard post to control the secured building exits, each of which has an unlocking instrumentality, without forbidding their emergency use. When activating the unlocking instrument to open a secured exit, there is a transmission of information to the security guard post and an initiation of a delay during which the security guard can forbid the opening of the exit. The unlocking instrument can also visually indicate events at the exit. The apparatus has an electro-mechanical lock, a sensor which is sensitive to motion of the unlocking instrument, a control line linking each door to be controlled to the security guard post, and a central electronic processing unit. A surveillance circuit responds to the sensor. A security circuit frees the unlocking instrument when a fault is detected.

20 Claims, 20 Drawing Figures

ADDRESS AND DECODING CKT 74

MULTIPLEX AND DETECTION CKT. 72

CONTROL CIRCUIT 73

CONTROL PANEL FOR MICROPROCESSOR

VIDEO PROCESSOR 123

SURVEILLANCE AND CONTROL SYSTEM FOR EMERGENCY EXISTS INSTALLED IN A BUILDING

The present invention concerns processes and apparatus to unlock emergency exits. It also concerns a surveillance and control system for emergency exits installed in a building.

The emergency exits which are provided in buildings open to the public and are intended for the rapid evacuation of the public in case of accident, such as a fire, have parts for instantaneous opening which must be unlocked under the push of people which may be excited by a motion panic. In practice, to avoid the illegal use of these exits either to introduce people in the building, or to take out merchandise, the user eventually blocks these exits, thus making them unserviceable. In buildings provided with a security watch apparatus, it is sometimes provided that the opening of security exits triggers an alarm which alerts the security guard post; this apparatus somewhat limits their illegal use, however, it is not totally efficient.

It is thus necessary to provide an apparatus in order to control the use of emergency exits to avoid all abnormal use while allowing them to always be available for their intended use, namely the rapid evacuation of people in the case of accidents or disasters.

The present invention has as an object a procedure allowing, in a building comprising at least one security guard post, to control the security exits each provided with an unlocking instrument, without forbidding their use in the case of a panic or incident. It also has as its object an unlocking apparatus carrying out the process.

In accordance with the process of the invention, activating the unlocking instrument to open a security exit initiates the transmission of information to the security guard post and the initiation of a first time delay during which the security guard can, during a second time delay forbid the opening of the second exit, the opening of the exit being authorized, either at the end of the first time delay, or, in the case of the intervention of a security guard, at the end of a second time delay.

In accordance with another characteristic of the invention, the activation of the unlocking instrument to open a security exit also commands a visual indication concerning the exit of concern.

In case the security guard does not intervene, at the end of the first time delay, a third time delay is initiated, at the end of which an authorization to block the door will be sent to the security guard post.

In accordance with another characteristic, an apparatus is provided carrying out the process and is comprised of an electro-mechanical lock blocking the unlocking instrument, a sensor sensitive to motion on the said unlocking instrument, a control line linking each door to be controlled at the security guard post and, at the security guard post a central electronic processing unit comprising a surveillance circuit for the sensor and a security circuit which frees the unlocking instrument when a fault is detected.

With the above mentioned process and apparatus, one can avoid the misuse of security exits, in particular their illegal use since a security has, for example, the possibility, during the first time delay and, eventually, the second, to go on to the location where the opening of the exit is requested.

In buildings with large service areas, at least some of the exits can be far from the security guard post and, in this case, a security guard does not have the time to go to the exit which has transmitted a call to verify if it is necessary that the door be open.

In some known systems, video surveillance apparatus is provided which is comprised of display apparatus such as a video screen for each exit being watched. However, these systems have inconveniences. First, the time during which a security guard can intervene is very short, for example eight seconds. However, the search by the security guard for the screen corresponding to the exit which has made a request can take a few seconds. In other respects, a solution requiring a display apparatus associated with each door is a very costly one. The object of the present invention is a low cost apparatus to control exits and which allows the rapid control of the area close to the door being requested to be opened.

In accordance with a characteristic of the invention, a system is proviced in which the exits being located out of sight from the security guard post are each provided with a surveillance camera, in which a unique display apparatus is connected to the different cameras by a video selection component transmitting the picture supplied by one of the cameras to a video monitor, and during reception of a request signal supplied by a sensor associated with an exit. The intervention of the security guard is dependent upon the selection by said sensor of the picture supplied by the camera surveilling the said exit.

Thus, the security guard only has to guard a single display apparatus, such as a video monitor screen, and he can see immediately all that is going on, who has sent the request for opening. Thus, he can, during the short time delay in which the exit is blocked, for example eight seconds, see what is going on at that exit and if he should intervene, for example by triggering a second time delay.

In accordance with another characteristic of the invention, in addition, the exit control apparatus has a video processing module which suppresses without superposition certain areas of the picture and replaces these by messages.

The messages, which may concern a number of exits, are permanently displayed on the visualizing screen while the picture of the door which has sent a request having been selected by the security guard appears on the screen only after it has been selected.

Advantageously, the central processing unit comprises, amongst its peripherals, a keyboard provided with, for each exit to be controlled, a selection key and a panel light indicating the state of the exit of concern as well as control keys provided with panel lights. Action is obtained for a particular exit by enabling first a selection key for that exit, then the appropriate control key.

The characteristics of the above mentioned invention, as well as others, will become clearer upon reading the following description of embodiments, said description being done in relation to the attached drawings, among which:

Figure 16:
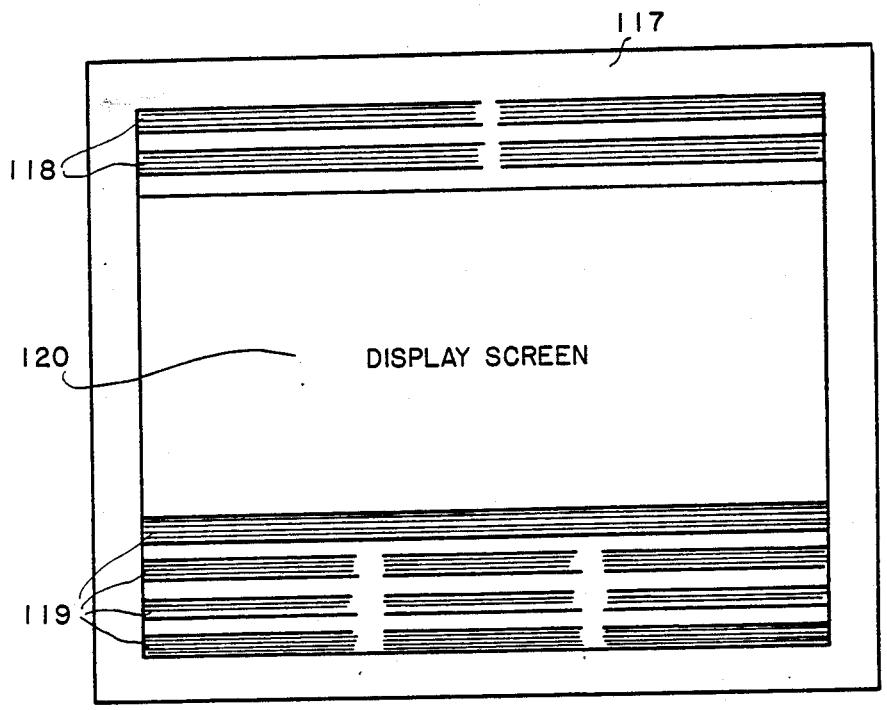
Figure 17:
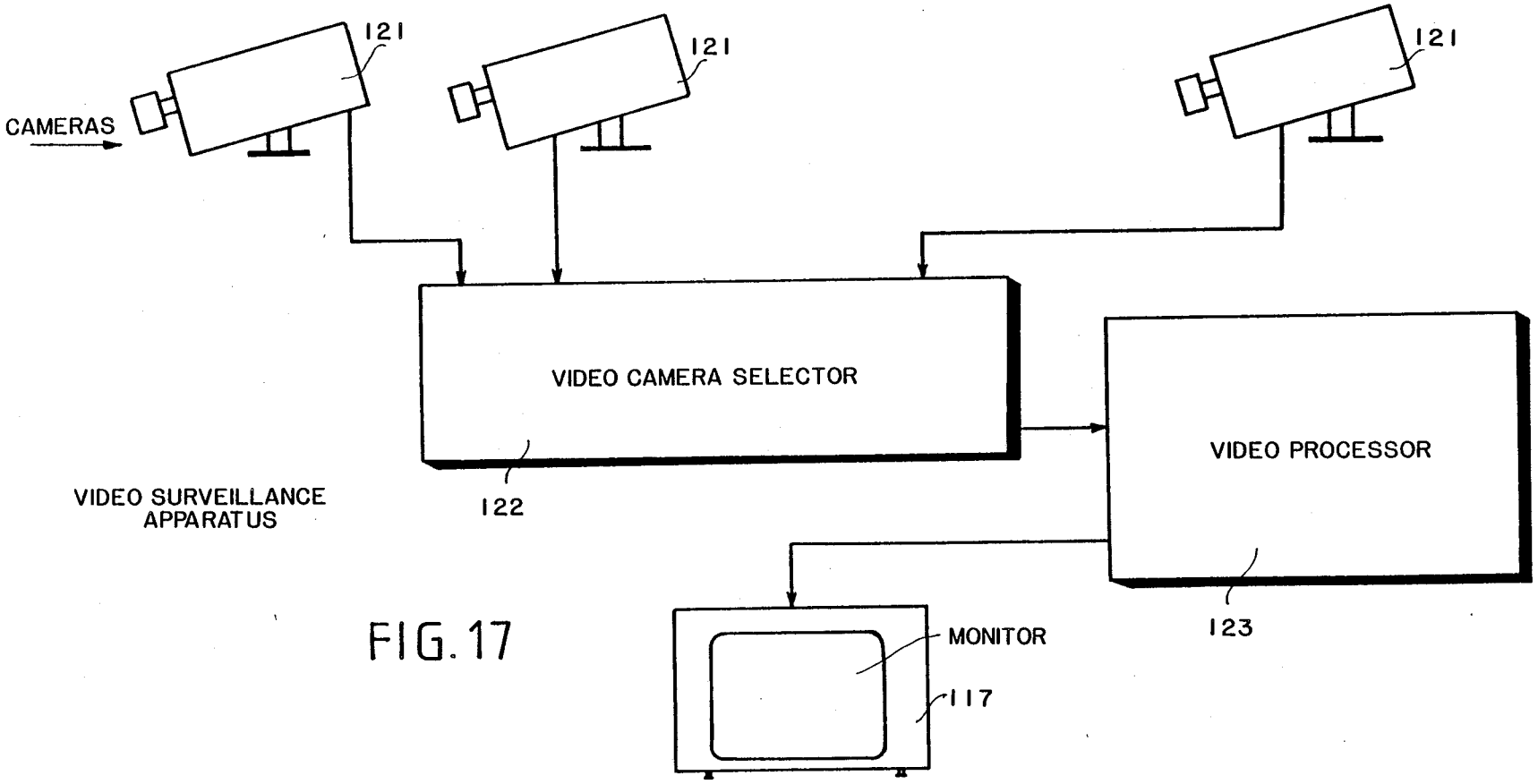
Figure 18:
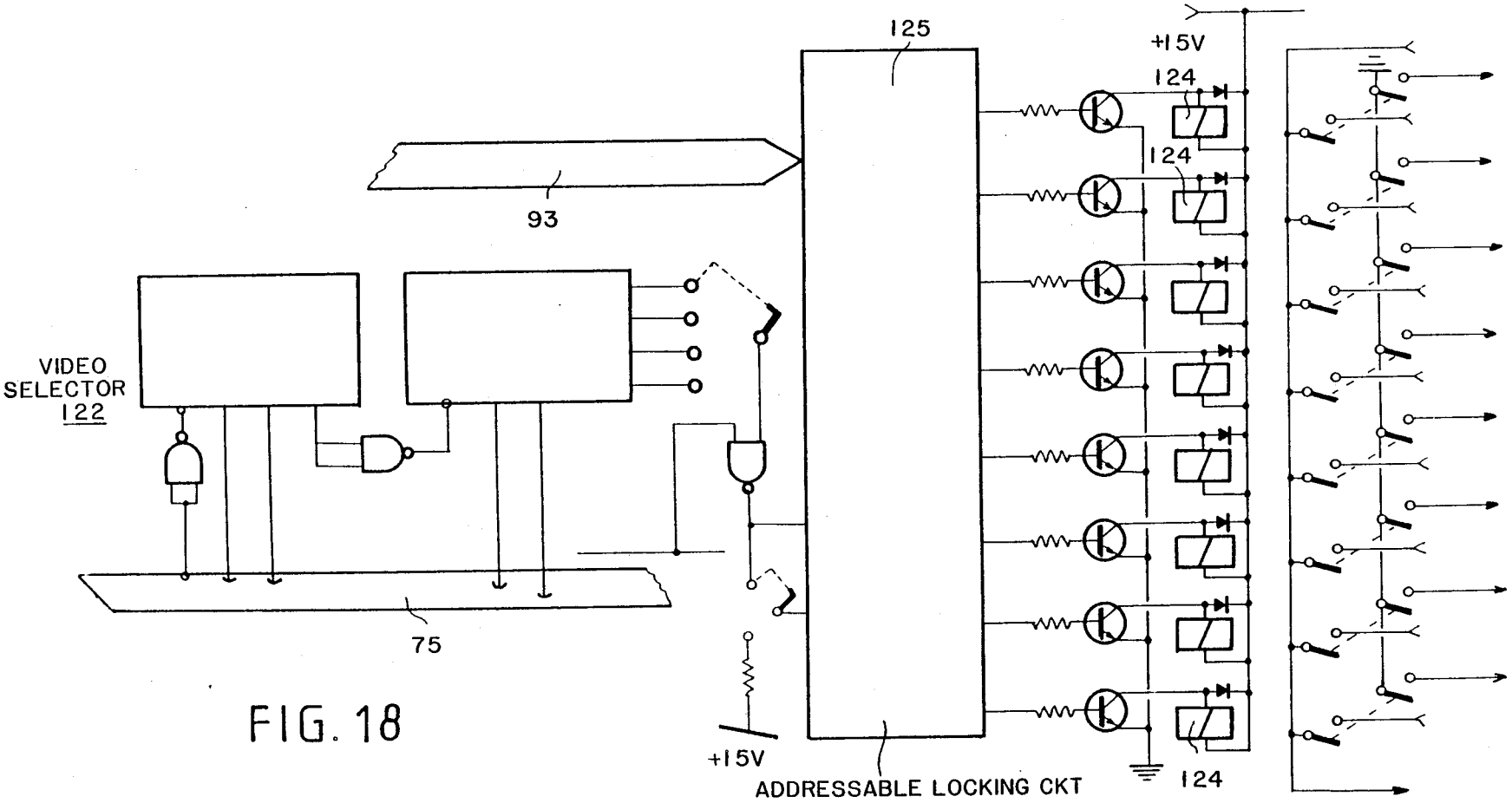
Figure 19:
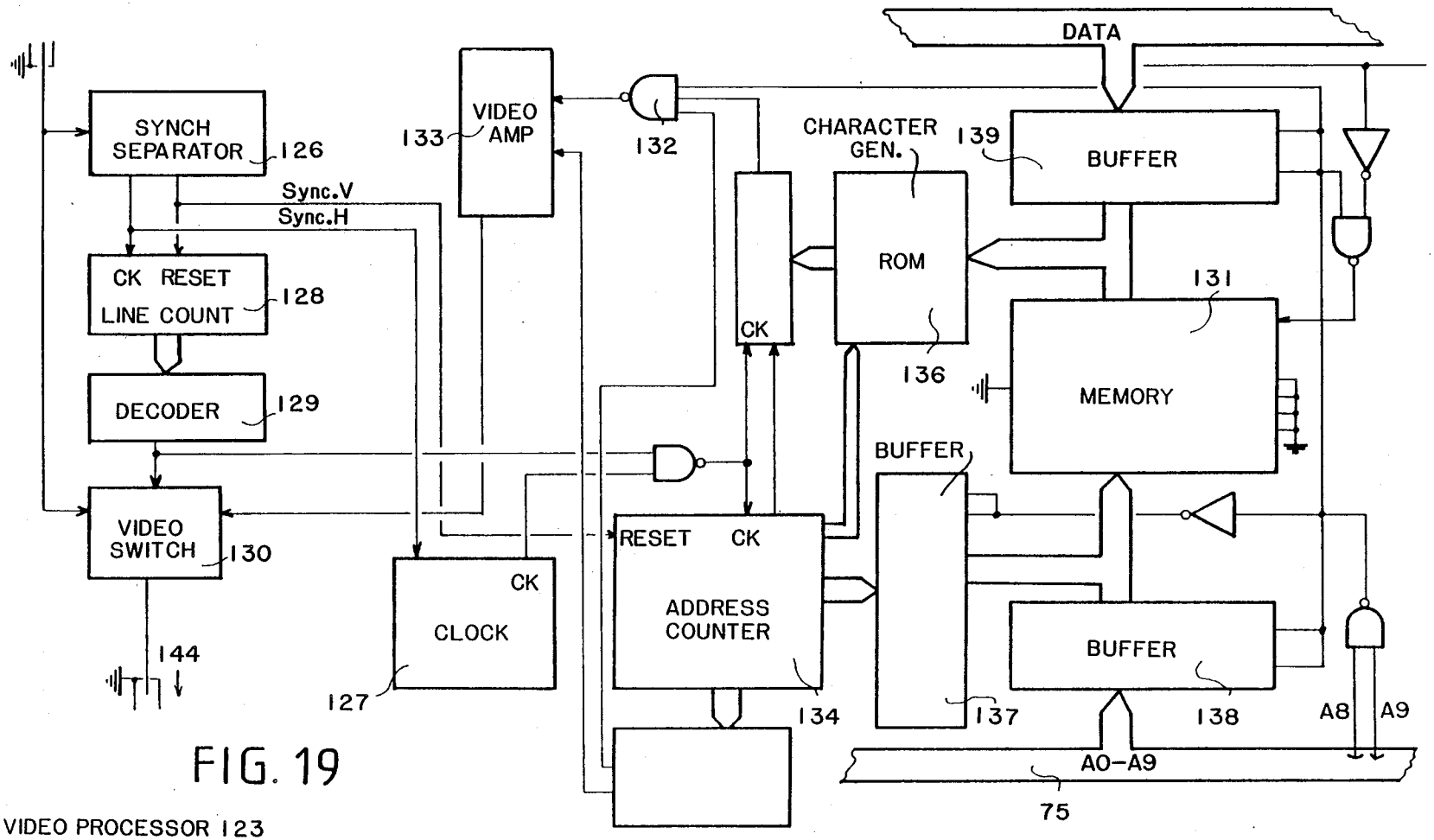

FIG. 16 schematically illustrates the display screen apparatus;

FIG. 17 is the block diagram of the surveillance system;

FIG. 18 is the schematic of a video selection module;

FIG. 19 is the schematic of the video processing module; and

Figure 20:
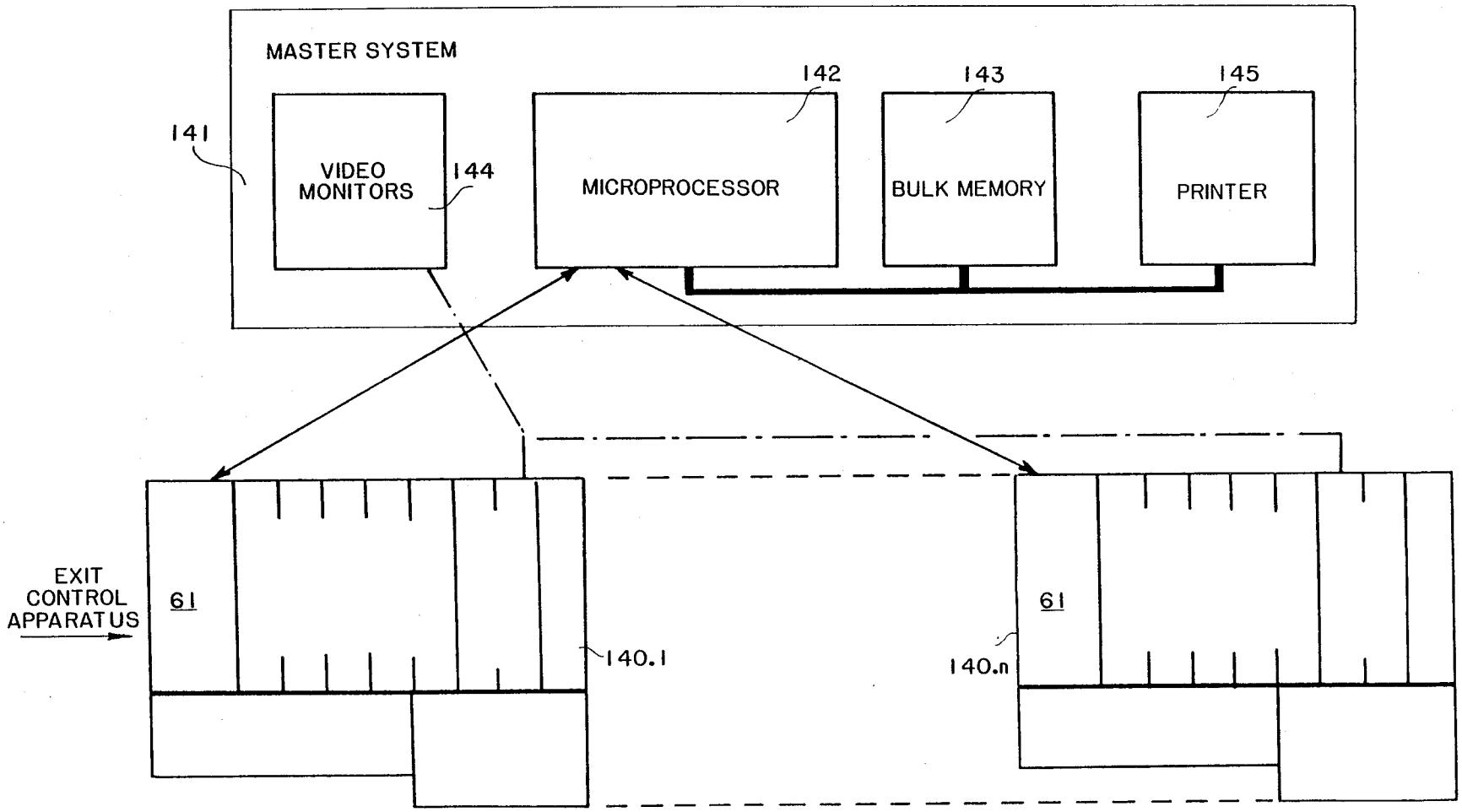

FIG. 20 illustrates a set of apparatus in accordance with the invention, controlled by a central microprocessor.

The invention is applicable in particular to the surveillance of emergency exits each of which is provided by an unlocking component which, for example, is made up of a bar said bar called anti-panic bar, a push on this bar unlocking, in principle, the door and allowing its opening.

In accordance with the present invention, upon activation of the unlocking component, activation which constitutes a request to open the exit of concern, an information is sent to the security guard post and this request triggers a time delay of short duration during which the door exit remains locked. During this delay, the security guard present at the security guard post may intervene and forbid the opening of the exit of concern and initiate a second longer duration delay. This second time delay is provided, for example, to allow security guards to go to the exit of concern or to have a picture of it, in order to assess what is going on. The unlocking of the emergency exit occurs either at the end of the above mentioned first time delay if the security guard has not intervened, or at the end of the second time delay if the security guard has intervened.

When, at the end of the first time delay, there has been no intervention by the security guard, a third time delay, of a duration relatively larger than the first time delay, is initiated at the same time as the exit of concern is unlocked. At the end of this third delay, or during the unlocking of the exit if the security guard has intervened, an indication, preferably audible or visual, is sent to the security guard post to indicate authorization to rearm the unlocking component. The security guard at the security guard post may then initiate a command to rearm the locking component and the exit will thus be relocked when it is returned to its closed position. With no intervention from the security guard, the exit of concern remains unlocked.

Advantageously, activation of the unlocking component triggers in the area of the exit of concern, at the same time as the first time delay is initiated, a signal indicating to the public that the exit will very shortly be unlocked.

Figure 1:
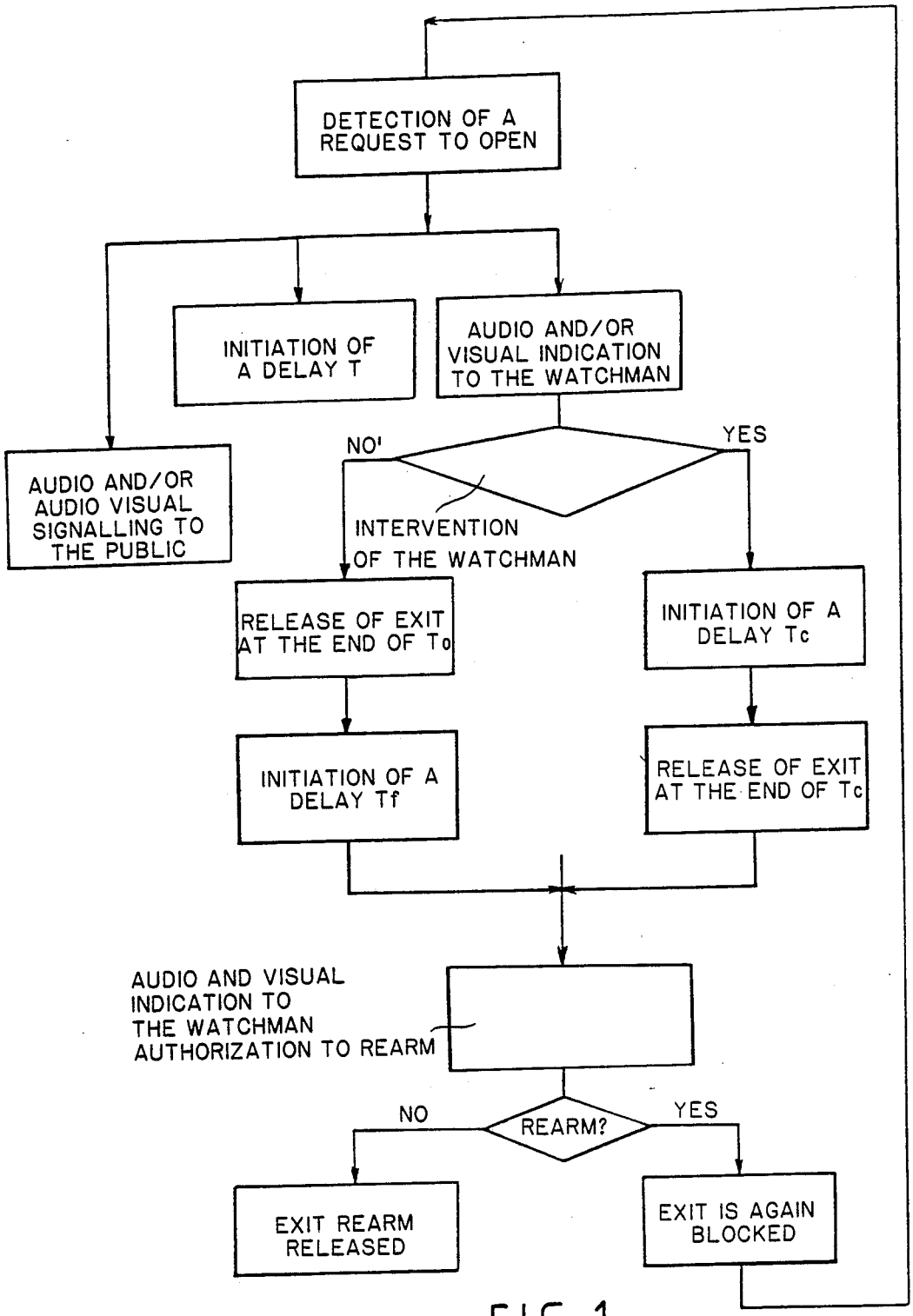
FIG. 1 is a diagram illustrating the operational sequence of the request to open process in accordance with the invention.

This process is illustrated in the form of a functional flow chart in FIG. 1. The detection of a request to open triggers a first time delay To, a signalling to the public and an indication to the security guard. The first time delay To is of short duration. It must simply be of sufficient duration to allow the security guard to verify if there has been an incident requiring the opening of security exits. The delay To can be for example for the duration of 8 seconds. The second time delay Tc may be longer since it is only initiated if a security guard has verified that there is no immediate danger. The delay Tc must be chosen such that the security guard is allocated sufficient time to go at the location of the exit of concern to verify what is happening. The third time delay Tf may be relatively shorter because it only triggers the authorization for the security guard to rearm the system. It may for example be 1 minute.

We observe that the invention allows the control, through a security observation apparatus, the use of emergency exits, while allowing the rapid evacuation in case of danger since the first time delay To during which the exit remains locked is of very short duration.

Once the system has been rearmed by the security guard, either the exit remains open for a reason to be seen below, or the exit is closed and we are back to the initial state.

If there exists in the building of concern incident detection apparatus such as fire detection devices, we provide advantageously that these detectors immediately act to unlock the emergency exits, independently of any request to unlock triggered by action on the unlocking component.

The invention also concerns an apparatus to carry out the process which has been described. This apparatus is applicable to security exits provided with an unlocking component such as an anti-panic bar whose action may be forbidden by an electrically controlled lock, such as an electro-mechanical lock.

Figure 2:
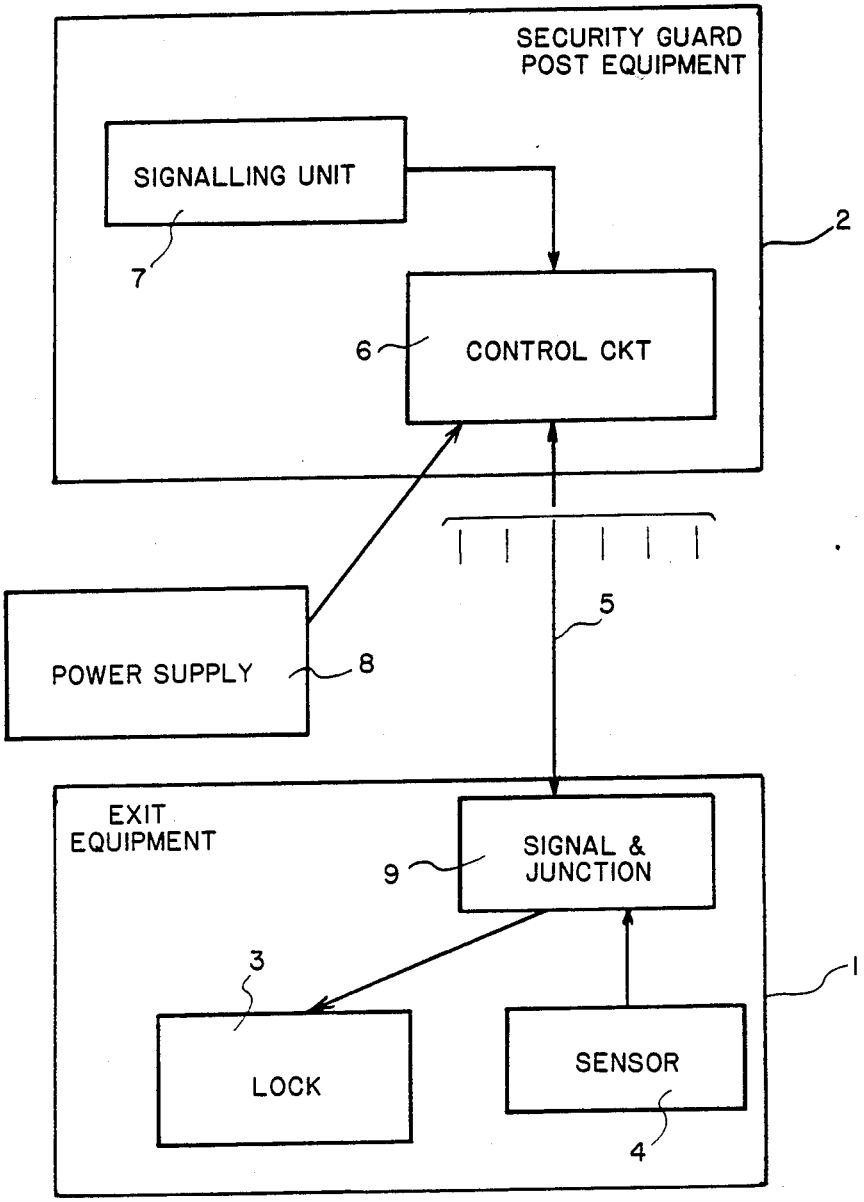
FIG. 2 is a block diagram of an apparatus that carries out the process of FIG. 1.

In the block diagram of FIG. 2 rectangle 1 designates the part of the apparatus which is installed at each exit to be watched, while rectangle 2 designates the part of the apparatus which is installed at the security guard post. In part 1 an electro-mechanical lock 3, a sensor 4 which detects any actions on the unlocking component, not shown, and a signalling and junction box 9 are provided.

The box 9 of part 1 is connected, by a command and control wire 5, to the central part 2 which essentially comprises an electronic subsystem 6 and a central command and signalling unit 7 with, for example a control desk and visual and audio indicators. A power unit 8 supplies the electrical energy necessary. The signalling and junction box 9 is connected to lock 3 and sensor 4. A number of parts 1 are normally connected by lines 5 to a central part 2. The interface subsystem 6 is used between the central unit 7 and the lines 5.

Figure 3:
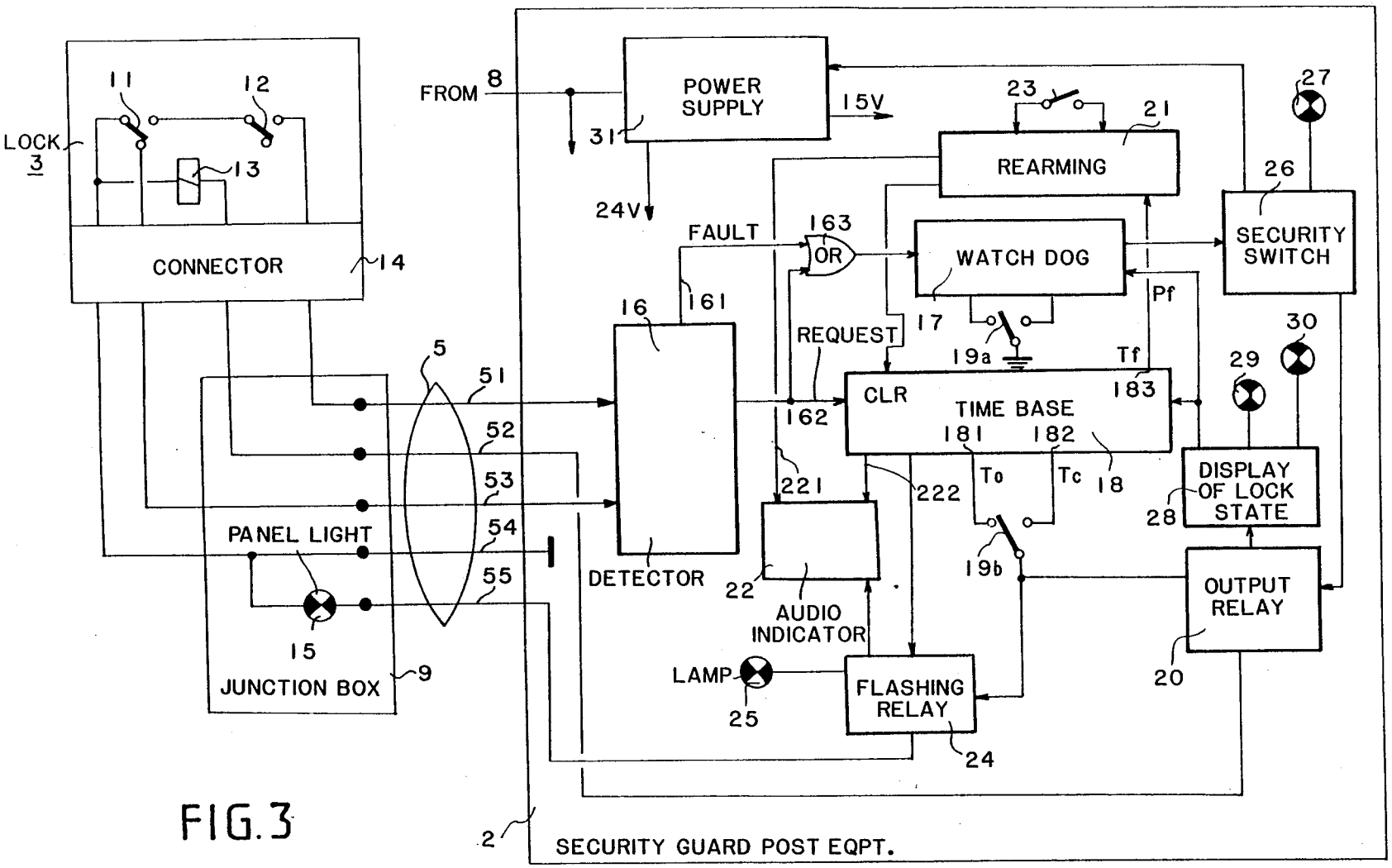
FIG. 3 is a detailed schematic of the apparatus shown in FIG. 2.

The schematic of FIG. 3 illustrates with greater detail, the apparatus of FIG. 2. The lock 3 is schematically illustrated by a relay 13 and a sensor 4 by the contacts 11 and 12. The parts 11, 12 and 13 are connected to the junction box 9 through a connection apparatus 14. A visual signalling component in the form of a panel light 15, is provided in junction box 9.

The command and control line 5 comprises five conductors 51 to 55. It may be made up of some sort of electrical installation cable comprising at least five conductors.

In central part 2, the two conductors 51 and 53 are connected to the two inputs of a detection circuit 16, the conductor 52 is connected to the output of an output relay 20 which allows the energizing of the unlocking relay 13, the conductor 54 is connected to ground to close the circuit of relay 13, and the conductor 55 is connected to the output of a flasher relay 24. In box 9, the conductor 55 is connected to conductor 54 by a panel light 15. The lock or relay 13 is obviously of positive security, that is it prevents unlocking of the exit as long as it is energized.

The detection circuit 16 is comprised of, on one hand, a security circuit which detects the appearance of any fault in part 1 and which thus commands the unlocking of the considered exit, and, on the other hand, means to detect a request originated by actions exerted on the unlocking component. It may thus generate two signals, namely a "FAULT" signal at its output 161 and a "REQUEST" signal at its output 162. The outputs 161 and 162 are connected to the inputs of an OR gate 163 whose output is connected to the input of a delay circuit 17 known as a "watch dog" circuit. The output 162 is connected to the input of a time base 18 which has three outputs 181, 182 and 183 supplying the three delays To, Tc and Tf. The double-switch 19*a*, 19*b* illustrates a command component enabled by the security guard. The outputs 181 and 182 are respectively connected to the fixed contacts of switch 19*b* whose moving contact is connected on one hand, to a command input of circuit 20 and, on the other hand to a command input of circuit 24. The moving contact of switch 19*a* is connected to ground, one of its fixed contacts being connected to terminal 171 and the other to terminal 172 of watch dog circuit 17. Upon transition from the rest state to the active state, switch 19*b* interrupts the delay To and activates the delay Tc, while switch 19*a* cancels the action of the watch dog circuit 17.

The output 183 of time base 18 is connected to one input of rearming circuit 21. One output of circuit 21 is connected to an input 221 of an audio indicator 22. At the end of delay Tf, the time base 18 acts on the rearming circuit 21 which acts on the audio indicator 22, which indicates that it is possible to proceed to rearming. The audio indicator 22 has a clock input 222 connected to the time base 18 which supplies it with impulses at an audible frequency or at a subharmonic frequency of it.

One output 184 of time base 18 is also connected to an input of circuit 24 to set the flashing frequency of it, the output of which is connected to a panel light of 25. One output of circuit 24 is also connected to an input of circuit 22.

One output of circuit 17 is connected to an electronic security switch 26 which has three outputs; one connected to a panel light 27, the other connected to the enable input of circuit 20 and the last to a supply circuit 31. The panel light 27 indicates the presence of a fault. One output of circuit 20 is connected to a lock display apparatus 28, the apparatus 28 having two outputs one of which is connected to panel light 29 and the other to panel light 30, the panel lights 29 and 30, respectively, indicating whether the lock is open or closed. An output PF of circuit 28 is connected to an input of circuit 17 and to an input of time base 18.

The supply 31 has an input connected to circuit 8 of FIG. 2 and supplies the necessary voltages for the operations of the different circuits of part 2. One output of supply 31 is connected to the CLR input of time base 18. The time base 18 also distributes the necessary timing signals to the different circuits.

Figure 4:
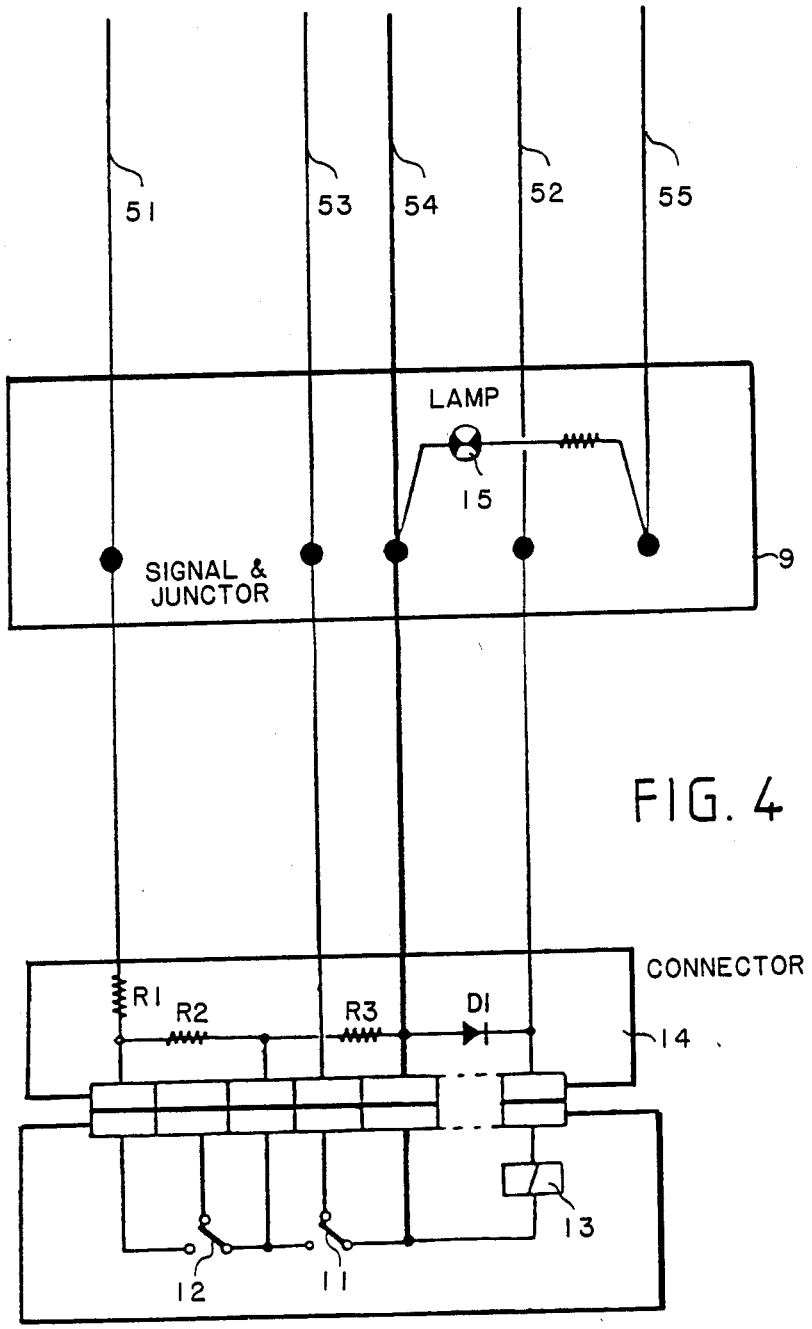
FIGS. 4 to 6 are circuit schematics for the apparatus of FIG. 3.

FIG. 4 illustrates one way of realizing the signalling and junction box 9 and the connector 14, connected to contacts 11 and 12 and to relay 13. The connector 14 contains a connect portion extending the wires 51 to 54, three resistors R1, R2 and R3 and diode D1. The first resistor R1 is in series with a wire 51 connected with the working contact of 12. Each of the two resistors R2 and R3 are respectively connected in parallel between the moving contact and the working contact of switches 11 and 12. The cathode of diode D1 is connected to wire 54 and its anode is connected to wire 52. The rest contact of 12 is inactive while that of 11 is connected to wire 53.

Figure 5:
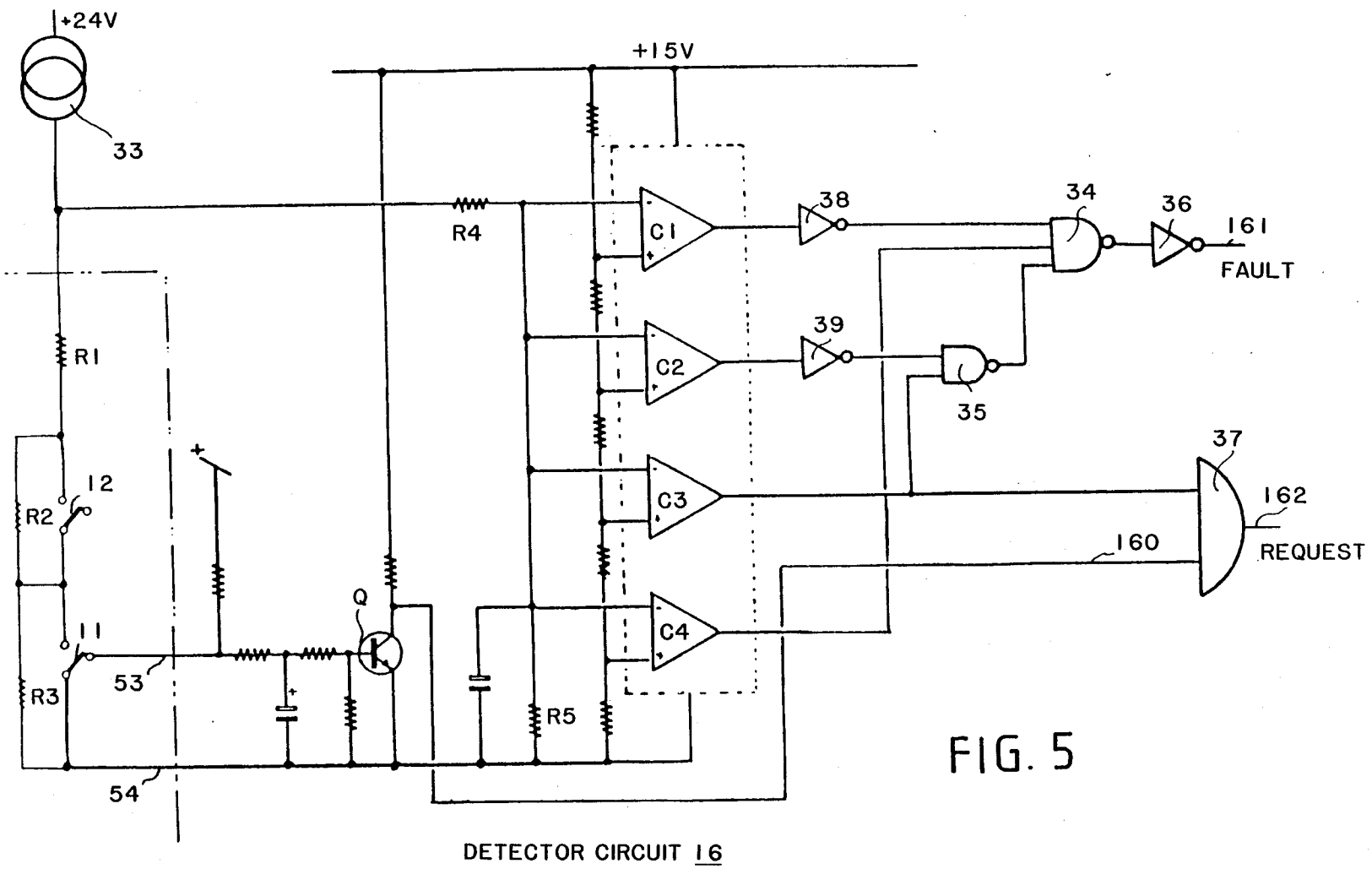

FIG. 5 is a schematic of a method of realizing the detection circuit 16, associated with the circuits of part 1 which determine its operation. The detection apparatus 16 is comprised of a constant current generator 33 which supplies wire 51 with constant current, and 4 operational amplifiers C1 and C2 set up as comparators. The non-inverting inputs of comparators C1 to C4 are respectively connected to the intermediate terminals of a resistance voltage divider set up between the +15 volt supply and ground. The inverting inputs of comparators C1 to C4 are connected to the common points of two resistors R4 and R5, the other terminal of R4 being connected to the output of 33 and the other terminal of R5 to ground. In practice, generator 33 supplies in a loop comprising the resistors R1, R2 and R3 of which R2 and R3 are shunted when the switches 11 and 12 are closed. As the current supplied by generator 33 is constant, for example 20 mA, the closing of switches 11 and 12 results in a substantial decrease in the impedance of the loop and subsequently the voltage. This voltage is divided by two through the two resistors R4 and R5 and is applied to the four comparators C1, C2, C3 and C4. The threshold of comparator C3 is set such that its output signal passes to state "1" (REST) to state "0" (ACTIVE), which supplies the request signal when 11 and 12 pass to the active state, shunting the resistors R2 and R3.

The wire 53 in detector 16 is connected by a classical resistance circuit to the base of a transistor Q whose emitter is connected to ground and whose collector is connected to an input of one AND gate 37 whose output is connected to the output 162. The output comparator C3 is connected to the other input of gate 37. The closure of 11 results in the conduction of transistor Q and we have at its collector a second request signal.

The comparative C1, C2 and C4 have thresholds set such that each can detect a fault. The threshold of comparator C4 is such that, in the case of a short circuit within the loop, that is when the voltage applied to the comparator is very close to zero, the signal supplied by this comparator passes from state "0" (NORMAL) to state "1" (FAULT). The threshold of comparator of C2 is such that in the case of a fault on a single one of the two switches, that is a variation in impedence smaller than in the case where the two switches are closed, the output signal of comparator C2 goes from the "0" to the "1" state. Finally, the threshold of the comparator C1 is set such that in the case of an open loop due to a broken line (the impedance of the line being very high), the output signal of comparator C1 goes from the "1" (NORMAL) to "0" (FAULT). Three logic operators NAND 34 and 35 and inverters 36, 38 and 39 serve to supply a fault signal.

Figure 6:
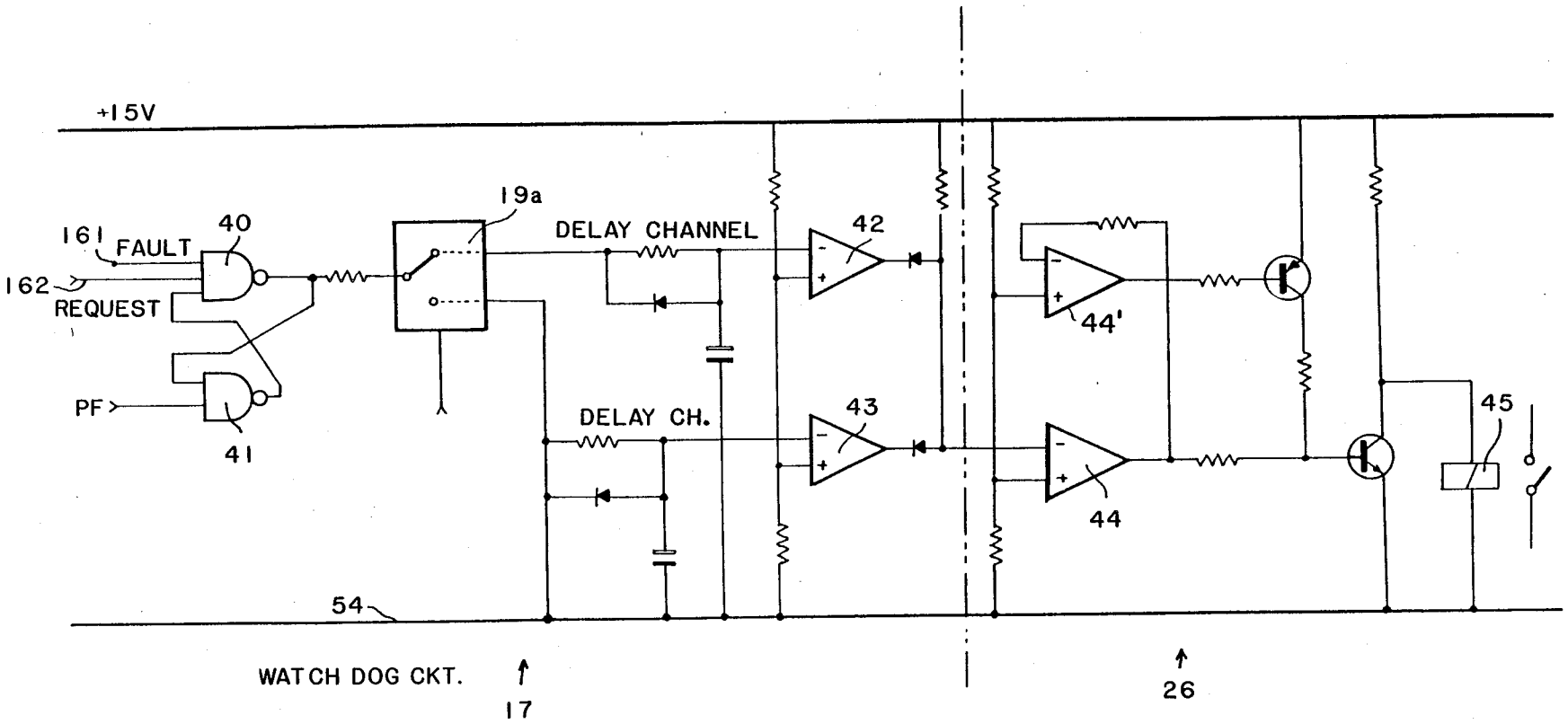

FIG. 6 illustrates a method of realizing the "watch dog" circuit 17 and the security switch 26. The outputs 161 and 162 of 16 are connected to two inputs of a three-input NAND gate 40 which constitutes, with a second NAND gate 41 a memory flip-flop. This flip-flop 40-41 is reset to "0" by a signal Pf which is supplied when the exit is unlocked.

This circuit 17 essentially defines two highly reliable delays whose precision is not very critical. The first delay is of a duration greater than the delay To and a second delay is greater than the delay Tc, their value being for example of approximately 10 seconds and 3.3 minutes. These two delays are selected by switch 19*a* which supplies at choice the delay of 10 seconds on its upper output or the delay of 3.3 minutes on its lower output. Normally, these delays do not reach their full term since they are respectively greater than the delays To and Tc, and that the memory is reset to zero when the exit is unlocked, that is at the end of either one or the other of the delays To and Tc. Circuit 17 thus intervenes only in the case of fault and then supplies, through one of the comparators 42 and 43 a signal to the security switch 26 whose input is made up of a comparator 44. The appearance of a signal on one of the comparators 42 and 43 and, afterwards at the input of comparator 44 results in the operation of the high reliability relay 45, for example a soft blade relay. The relay 45 is activiated on the appearance of a fault within the security switch 26. For this purpose, this security switch uses two channels arranged in a "crossed redundancy" set up. This set up rests on the hypothesis that a monolythic integrated circuit which suffers a serious fault will have all its operators simultaneously defective either by presenting short circuited outputs or high impedance outputs.

In a variation, the signalling and junction box 9 may comprise a series loop in the relay circuit 13 which is part of the accident detection apparatus such as fire detection devices, in such a way that in the case of a fire the unlocking of emergency exits is immediately achieved without the intervention of the unlocking component and without the intervention of a security guard.

In the case where the exit of concern has two panels, it is particularly advantageous to use a single junction box for the two panels, this box 9 having relays to transmit in a reliable manner all requests or calls originating from a single one of the two panels.

To summarize, the apparatus which has been described contains for each exit to be watched, a signalling and junction box which contains an electro-mechanical locking apparatus for the unlocking component and the sensor, eventually also visual and audible signalling apparatus. Each one of the junction and signalling boxes is connected by an appropriate cable to a central processing unit which is comprised of an industrial type microprocessor, that is a microprocessor particularly adapted to this type of process, and an exit interface 6 which advantageously controls a number of exits, for example 4 video selection components associated with a number of cameras, and in this embodiment, the video processing module which allows the sharing of the screen between pictures and messages at a control desk made up of a keyboard and panel lights.

Preferably, in an installation in accordance with the invention, each exit being located out of sight of the security guard post is provided with a surveillance camera which is connected to a single video monitor for the whole electronic system, through video selection components. Advantageously, when it is necessary, the control and signalling box supplies a mirror light projector when the exit concerned has been selected by the operator at the control desk.

Figure 7:
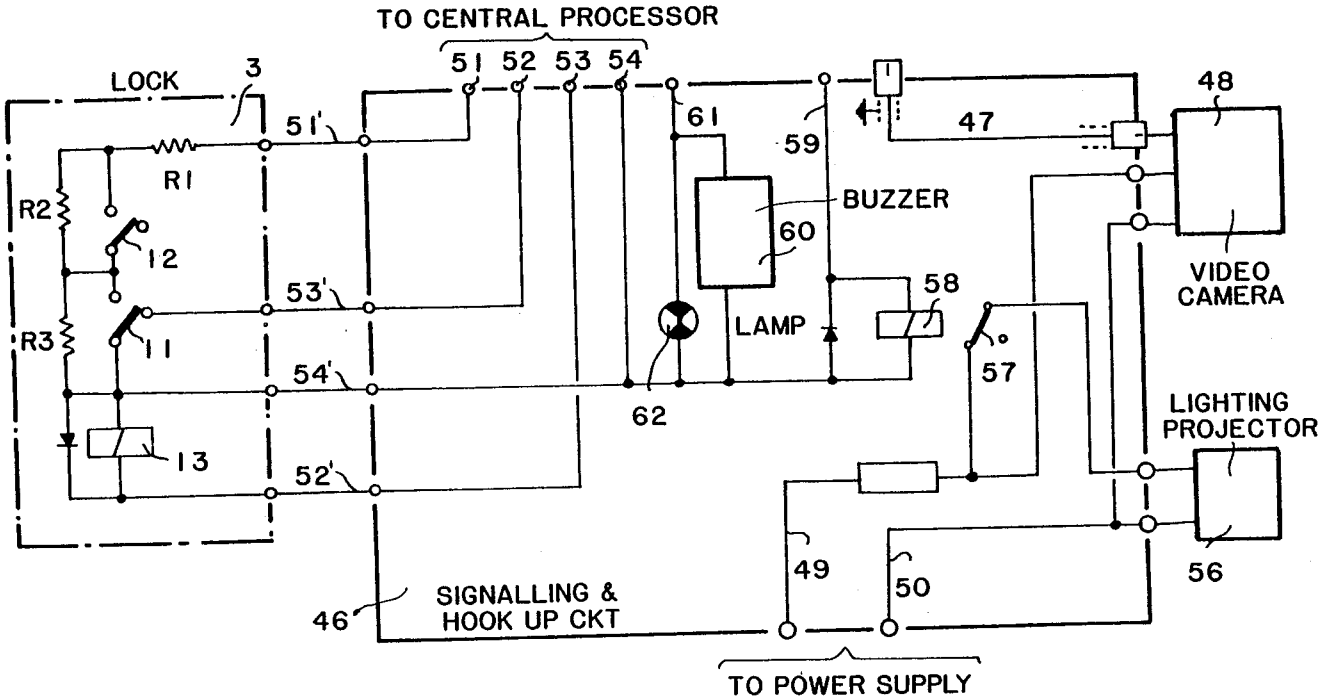
FIG. 7 is the schematic of the junction box joining one exit to the central processing unit.

FIG. 7 illustrates the block diagram of a junction and signalling box intended to be installed at an exit located out of sight of the security guard post. We recognize, represented schematically, the electromagnetic lock 3 of FIG. 4 which is connected by wires 51' to 54' to a signalling and hook up circuit 46 which replaces circuit 9 of FIG. 1. In circuit 46, the wires 51' to 54' are extended toward the central processing unit by wires 51 to 54.

The circuit 46 also is comprised of a portion of coaxial cable 47 extending the output cable of a video camera 48 to the security guard post. Two mains supply wires 49, 50 allow supplying of energy to the camera, as well as a lighting projector 56. On a tap-off wire 49, to projector 56, a working contact 57 is provided controlled by a relay 58 set up between the wire 59 and ground.

An audio notification component or buzzer 60 is also set up in circuit 46, between wire 61 and ground. A warning light 62 is connected in parallel with the buzzer 60. The buzzer 60 and the light 62 are intended to warn people that have requested the opening of the exit, that its opening will follow after a short time delay.

The circuit 46 may eventually have a loop connected in series with electromagnet 13 and connected to the fire detection device such as to automatically control the opening of exits in the case of fire.

Figure 8:
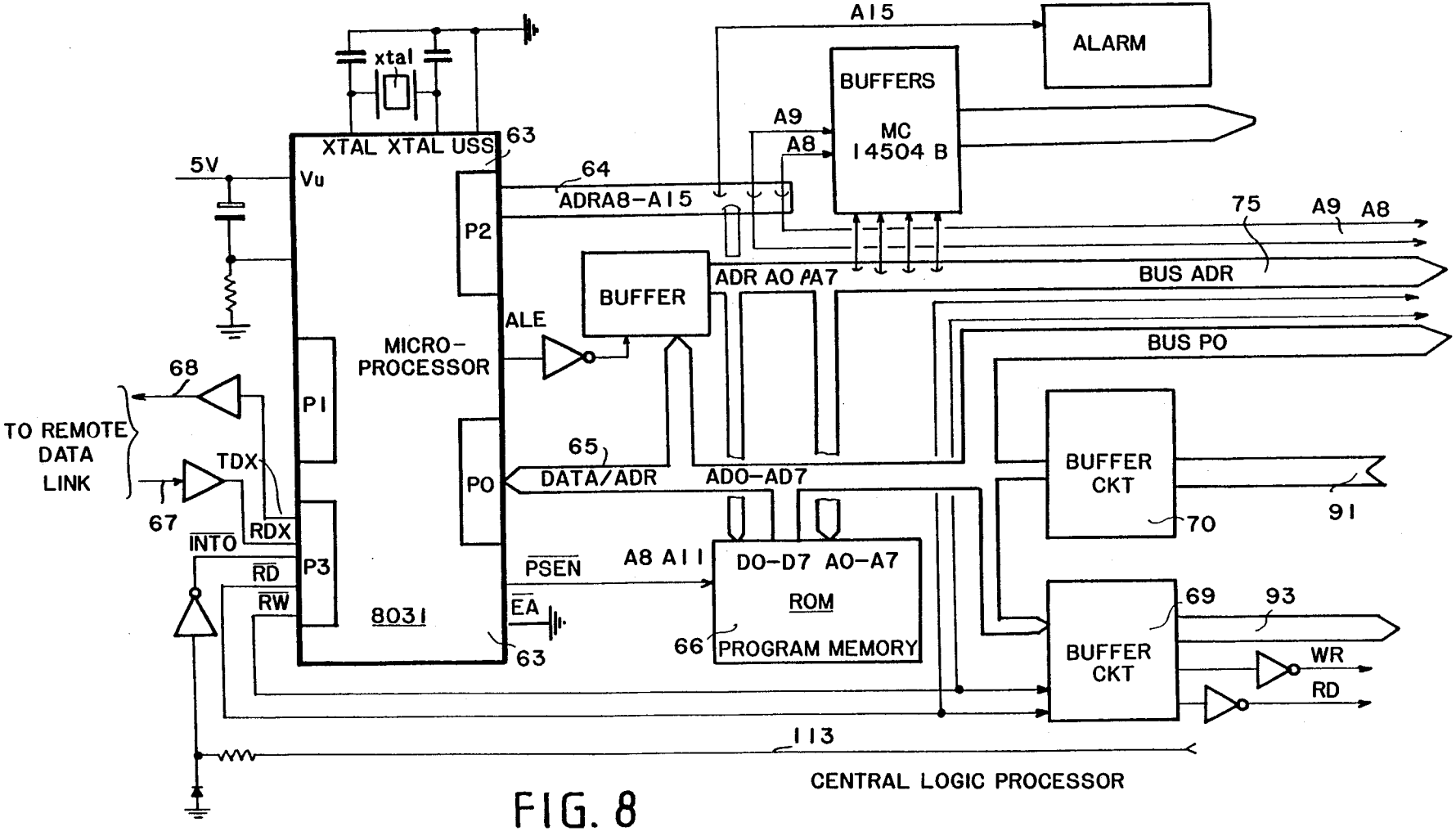
FIG. 8 is a block diagram of the integrated microprocessor within the central processing unit.

In FIG. 8, we have shown the schematic of a logic central processing unit 7 having a microprocessor 63. The microprocessor 63 is, for example, a circuit commercially available from the Intel Company under reference number 8031, which is particularly applicable to industrial tasks. The microprocessor 63 is in particular connected to two buses 64 and 65, bus 64 being used as the address bus transmitting the most significant bits and bus 65 being used either as address bus to transmit the least significant address bits, or as data bus. A read only memory 66 providing the external program memory is connected to bus 65. The microprocessor 63 also has a series input 67 and a series output 68 intended for a remote data link. The data is transmitted or received through buffer circuits 69 or 70 respectively, these circuits being used as adapters between the TTL logic circuits and the CMOS type logic circuits.

Figure 9:
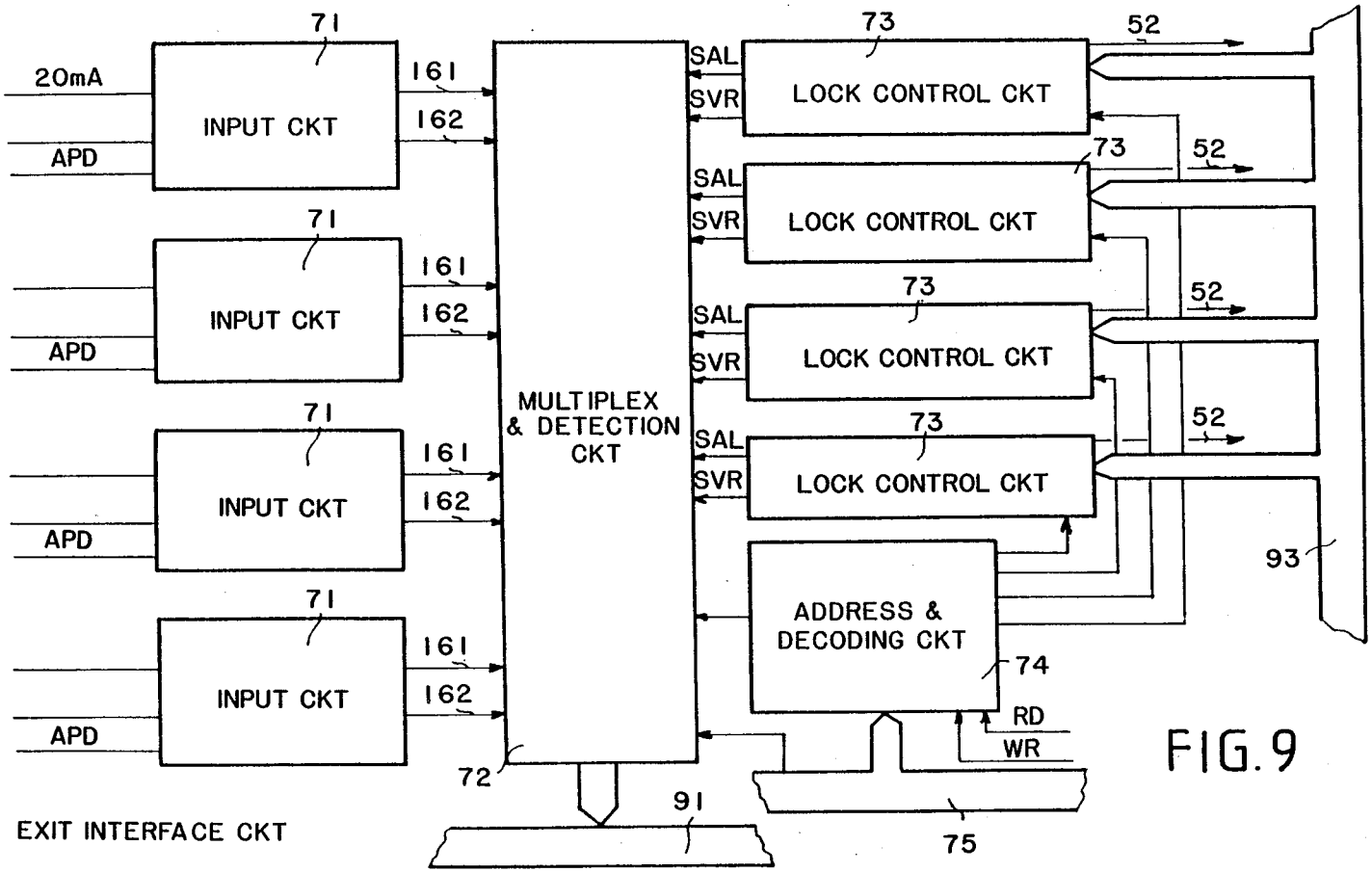
FIG. 9 is the block diagram of one of the interface cards for the exits.

FIG. 9 illustrates an exit interface circuit associated with microprocessor 63. In particular the circuits of FIG. 9 are provided to be set up on an integrated circuit card to serve four exits. An input circuit 71 which receives for each exit to be processed the corresponding signal from circuit 46, FIG. 7 is provided. A multiplexing and detection circuit 72 carries out the cyclical polling of the four input circuits 71. Four control circuits 73 which control the lock electromagnets 13 are also provided. Each control circuit has an output wire 52 going to the corresponding lock. In other respects, it is connected to an address decoder circuit 74 which is connected to an address bus 75.

Figure 10:
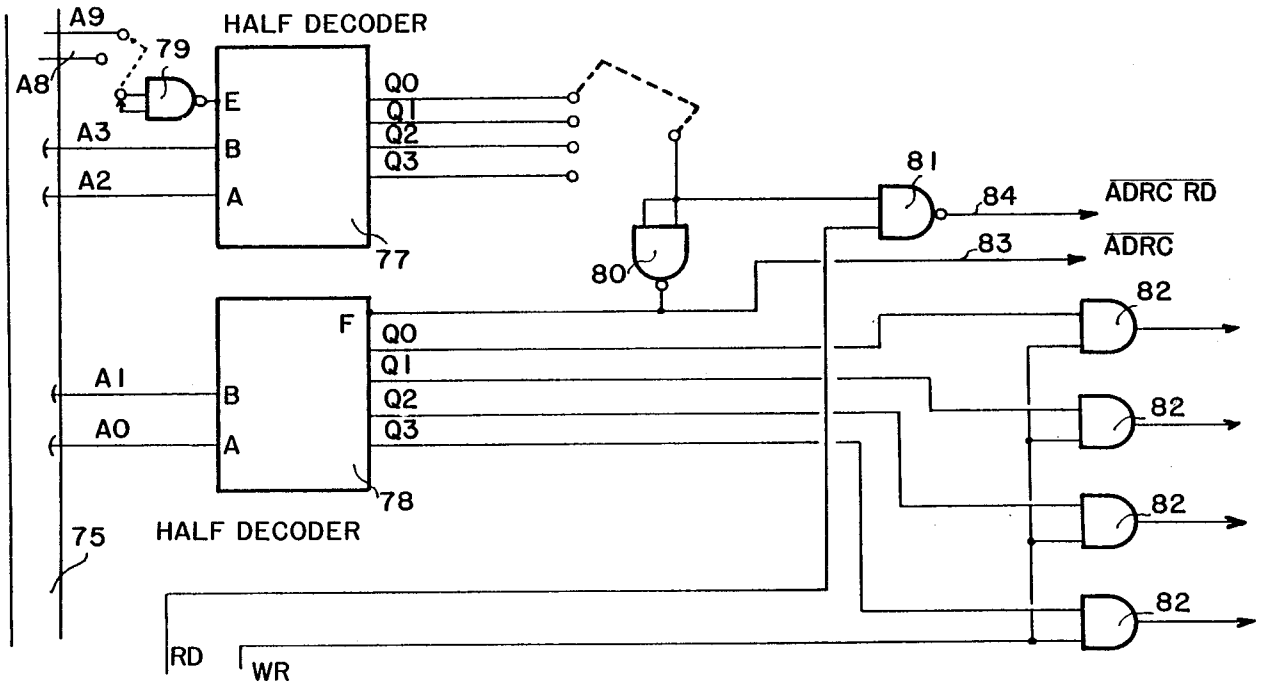
FIG. 10 is a schematic of the address decoder for the exits being watched.

FIG. 10 illustrates the schematic circuit of the addressing and decoding circuit 74 connected to bus 75. The decoder circuit is comprised of two half decoders 76 and 77 respectively supplying the address of the card on which are inserted the interfaces of FIG. 9 and the address of one channel from four intended for the writing of the control signals in circuit 73.

Circuit 77 has its enable input E connected by an inverter 79 to wire A9 of bus 75 and inputs A and B connected to wires A2 and A3 of 75. Depending on the card address, one of the four outputs Q0 to Q3 or 77 is connected, on one hand, to one input of an inverter 80 and, on the other hand, to an input of a NAND gate 81. The output of inverter 80 is connected to the enable input E of half decoder 78.

The inputs A and B of 78 are respectively connected to wires A0 and A1 of 75. Each of its outputs Q0 to Q3 is connected to an input of AND gate 82. Thus, each output Q0 to Q3 is associated with a circuit 73.

The other input of gate 81 is connected to the read enable wire RD while the second inputs of gates 82 are connected to the write enable wire WR. The outputs of gate 82 are respectively connected to the write enable inputs of circuits 73. The output of inverter 80 is connected by a wire 83 to circuit 72 while the output of gate 81 is connected by a wire 84 to the same circuit 72.

Figure 11:
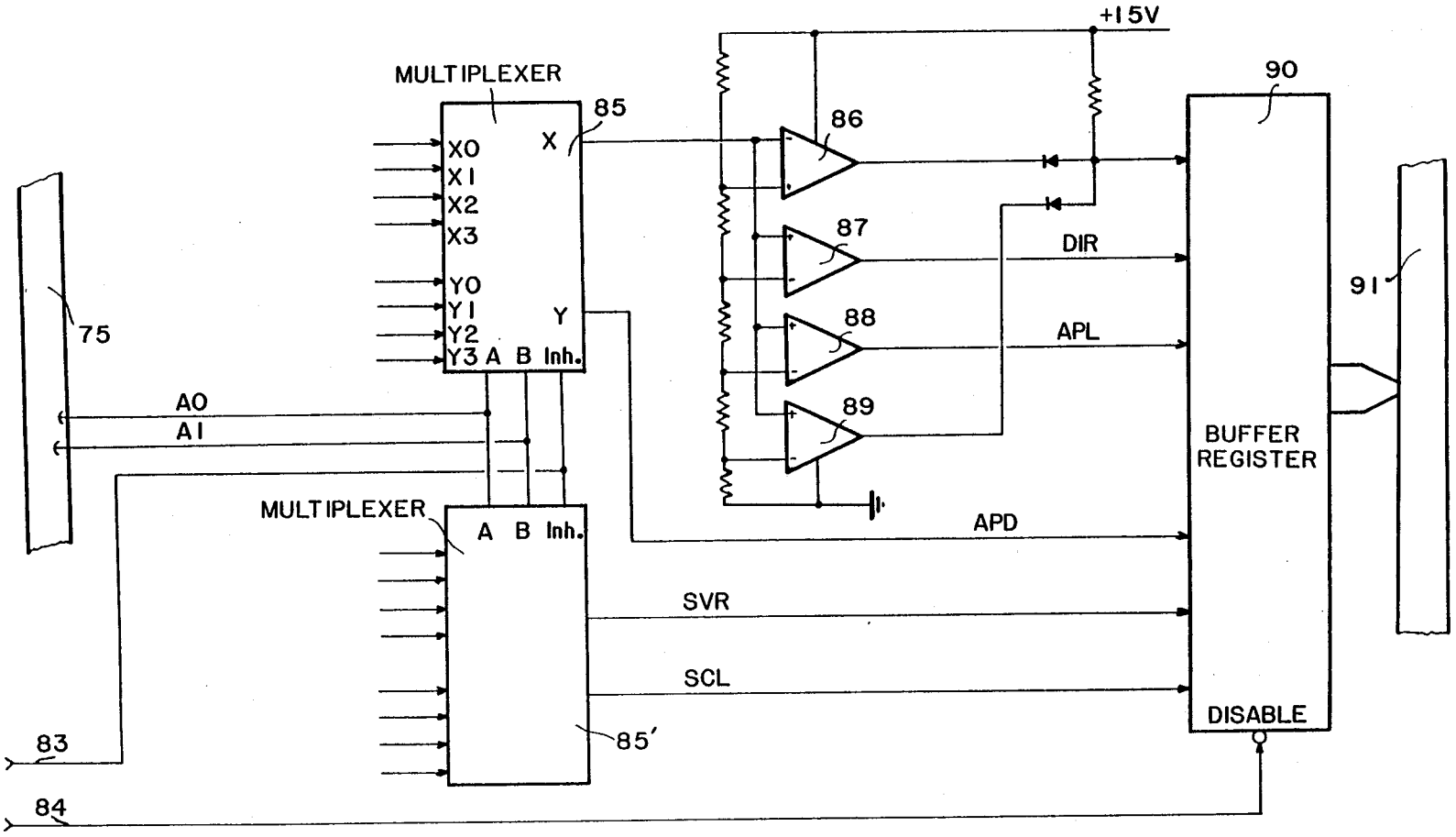
FIG. 11 is a schematic of the detection and multiplexing circuits.

FIG. 11 is a schematic of the multiplexing and detection circuit 72, FIG. 9. The wires 51 and 160 of each input circuit 71 are respectively connected to the VD0 to VD3 inputs, on one hand and APD0 to APD3, on the other hand, by an analog multiplexer 85. The multiplexer 85 comprises an X output extending the inputs 51 and a Y output extending the inputs 160. The X wire is connected to the inverting input of a comparator 86 and to the non-inverting inputs of three comparators 87 to 89. The non-inverting input of comparator 86 and the inverting inputs of comparators 87 to 89 are respectively connected to different terminals of a voltage divider. In practice, we have approximately the comparing circuit of FIG. 3. The outputs 86 and 89 are connected by a gate - made up of two diodes - to a first input of a buffer register 90, the outputs of comparators 87 and 89 are respectively connected to the second and third inputs of register 90. The Y output of multiplexer 85 is connected to the fourth input of 90. The inhibit input of 85 is connected to a wire 83 originating from the address decoder 74 while the reset input of register 90 is connected to wire 84.

The comparators 86 to 89 are fast comparators. The register 90 constitutes an interface with the data input bus 91.

Figure 12:
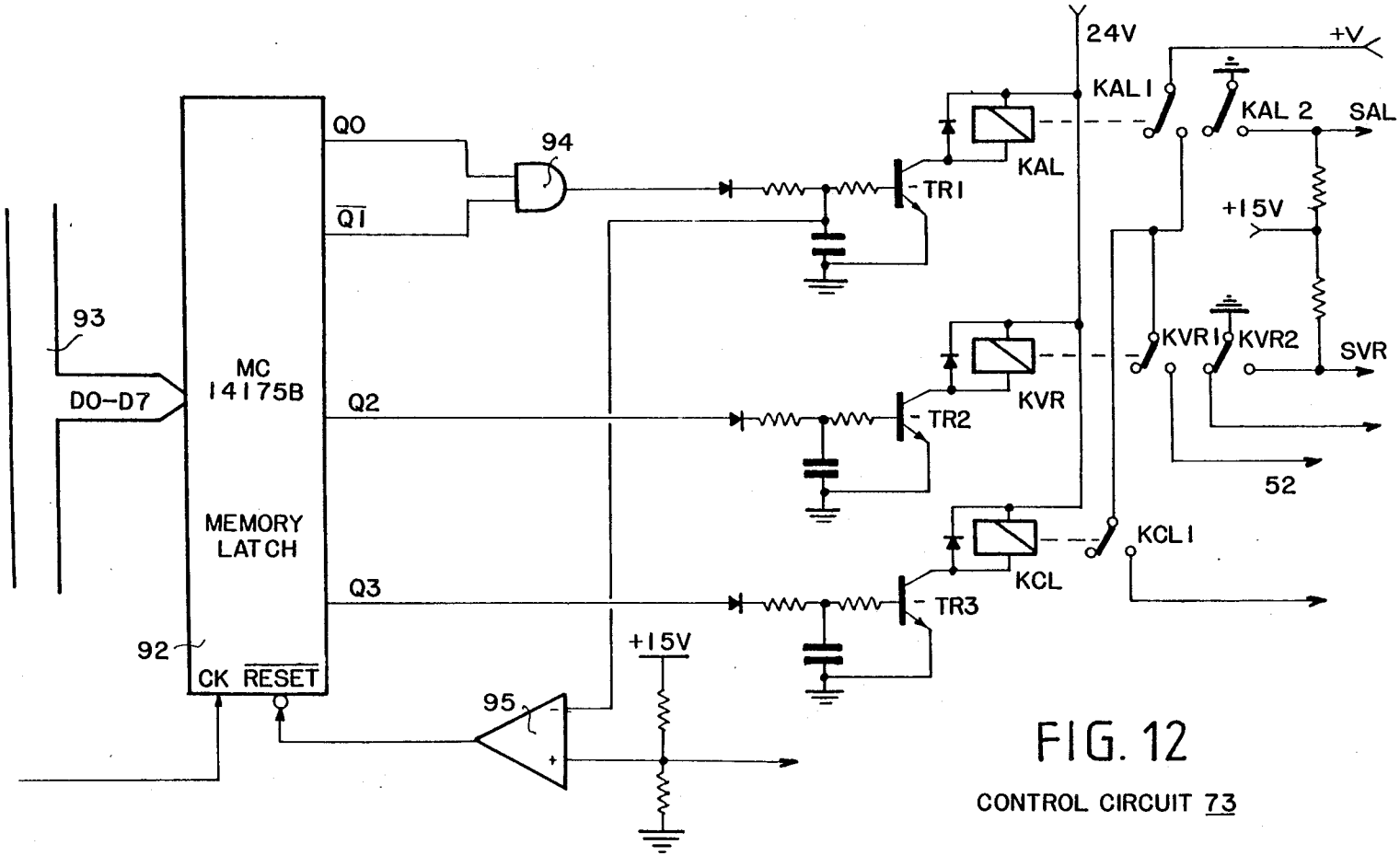
FIG. 12 is a schematic of the control circuit and the watch dog circuit.

FIG. 12 is a schematic of the control circuit 73. It comprises a memory or latch 92 whose data input is connected to the data output bus 93. The memory 92 has four output Q0, $\overline{Q1}$, Q2 and Q3. The outputs Q0 and $\overline{Q1}$ are connected to the inputs of an AND gate 94 whose output is connected to the base of the power transistor TR1 whose emitter is connected to ground and whose collector is connected to a terminal of a relay KAL whose other terminal is connected to a supply of 24 volts. The output Q2 is also connected to the base of a power transistor TR2 whose collector circuit has a relay KVR. Finally, the output Q3 is connected to the base of a power transistor TR3 whose collector circuit has a relay KCL.

The relay KAL has two working contacts KAL1 and KAL2, one connected to a supply voltage TS, the other connected to ground. The relay KVR has two working contacts KBR1 and KBR2, one connected to the working contact of KAL1 and the other to ground. The relay KCL has a working contact KCL1 connected to the working contact of KAL1. The working contact of KVR1 is connected to wire 52 and the working contact of KCL1 is connected to wire 55. In other respects, the working contact of KAL2 is connected to a supply voltage of +15 V by a resistor of 10 kilohms; it is also connected to the state output SAL. The working contact of KVR2 is connected to a +15 V source through a resistor of 10 kilohms; it is also connected to state output SVR. The rest contact of KVR2 is connected to the control desk.

Finally, the input circuit of each transistor TR1 to TR3 comprises two resistors in series, with their common point connected to ground by a capacitor, for example of ten microfarads. This capacitor serving as an analog type "watch dog" time delay. Furthermore, the isolated terminal of the capacitor associated with transistor TR1 is connected to the inverting input of a comparator 95 whose non-inverting input is connected to a voltage divider setting it at +12 V. The output of 95 is connected to the zero resetting input of memory 92.

In practice, the Q0 output indicates that the memory is in use, the $\overline{Q1}$ output indicates that it is inactive, with as a result that the relay KAL is normally active. The Q2 output activates relay KVR which is used to maintain lock 13 closed. The Q3 output of relay KC1 activates flasher 15, FIG. 3.

Figure 13:
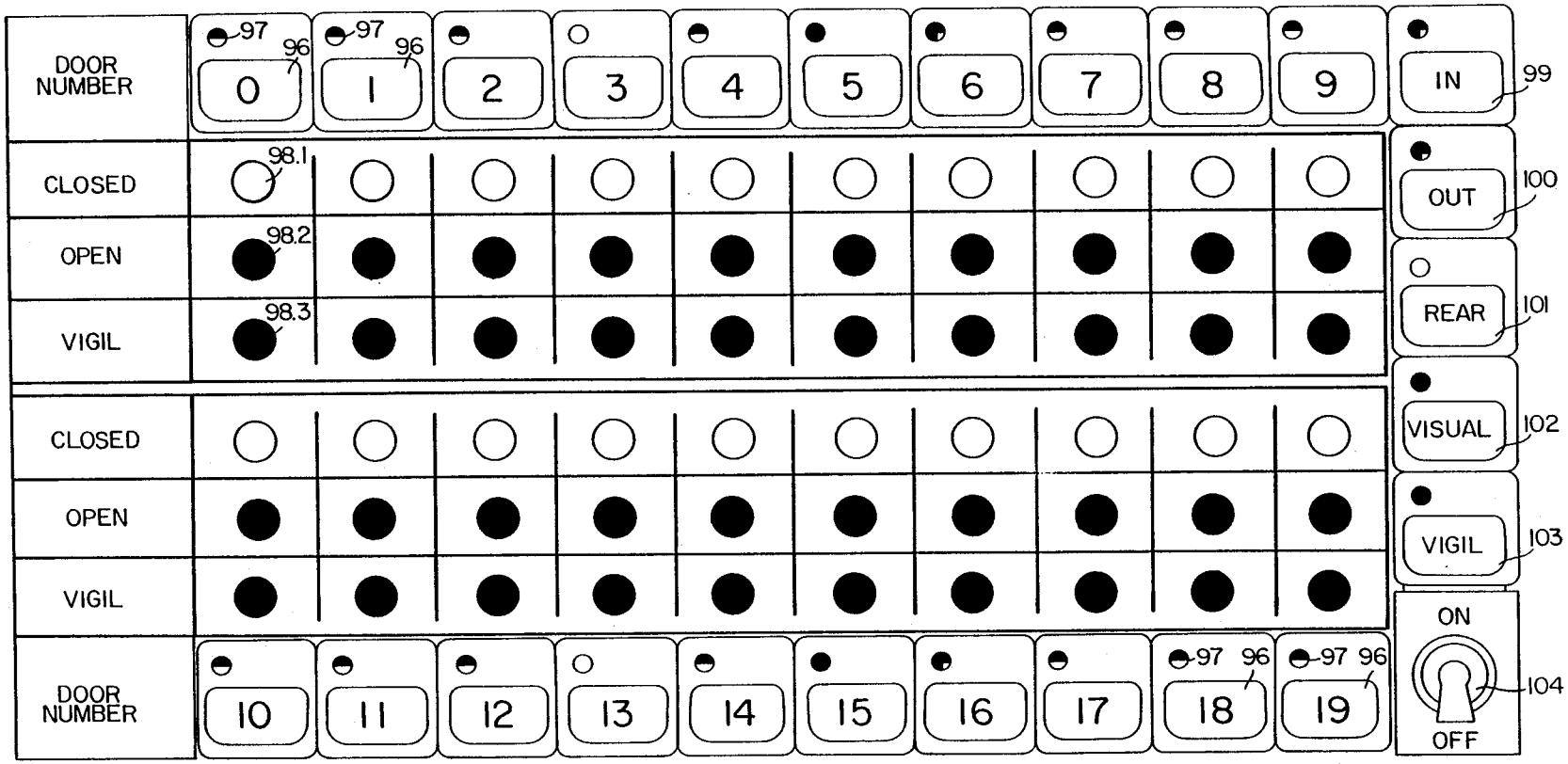
FIG. 13 illustrates the control keyboard of the apparatus in accordance with the invention.

FIG. 13 illustrates the control desk of the microprocessor. It has a conventional keyboard with selection keys for the exits. In the example described, there are 20 exits. The keys 96 have a light 97 that may flash. To each key 96, are also associated three lights 98.1, 98.2 and 98.3 respectively corresponding to the three states of an exit, that is "OPEN", "CLOSED", or "UNDER THE INTERVENTION OF A SECURITY GUARD". The purpose of the function keys 99 to 103 will be described below. We must know that action on the state of an exit is carried out by selecting an exit and activating a control key. Finally, an on/off switch 104 is provided.

Figure 14:
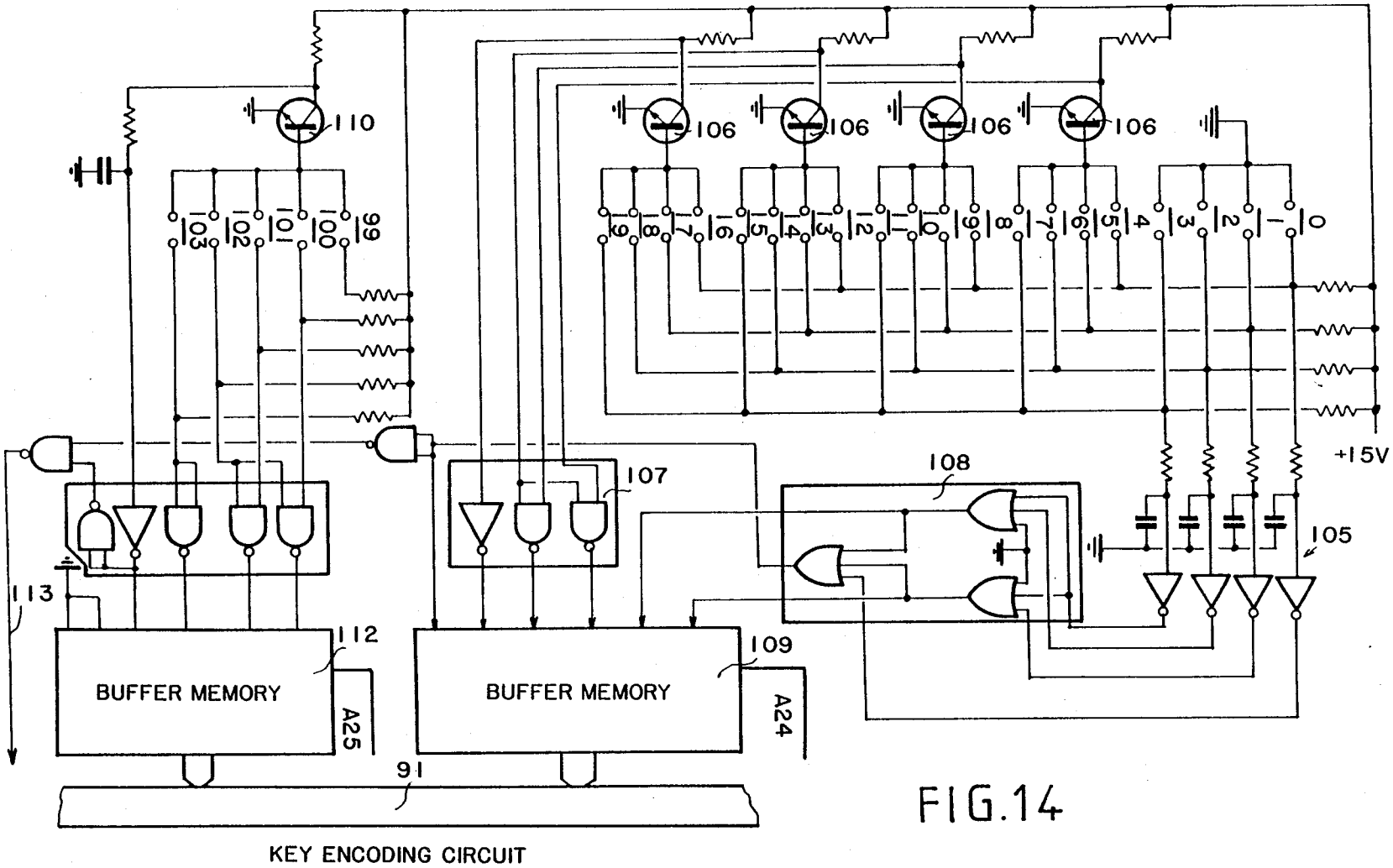
FIG. 14 illustrates the coding for the keys at the control desk.

FIG. 14 illustrates the key encoding circuit at the desk.

The exit identification keys are grouped in sets of fours to make up five groups. In each group, the keys on the same row are respectively connected together to anti-bouncing circuits 105 each made up by an RC filter and a trigger. The other terminals of the group are connected to ground and those of the other groups are individually connected to the base of the switching transistor 106 whose collector is connected to a logic system 107. The outputs of the four circuits 105 are encoded by a logic system 108 which also generates a "VALID" signal. The outputs of systems 107 and 108 are connected to the D0 to D5 inputs of a buffer memory 109 whose outputs are connected to bus 91.

The terminals of the function keys are also connected, on one hand, together to the base of the transistor 110 and on the other hand, individually to a logic system 111. The collector of transistor 110 and the three outputs of system 111 are connected to inputs D5, D0, D1 and D2 of a buffer memory 112 whose outputs are connected to bus 91. The outputs of 108 and 111 are also combined to be connected to the interrupt wire of the microprocessor. It should be noted that the "VALID" signal allows the distinguishing between the exit number keys and the function keys.

Figure 15:
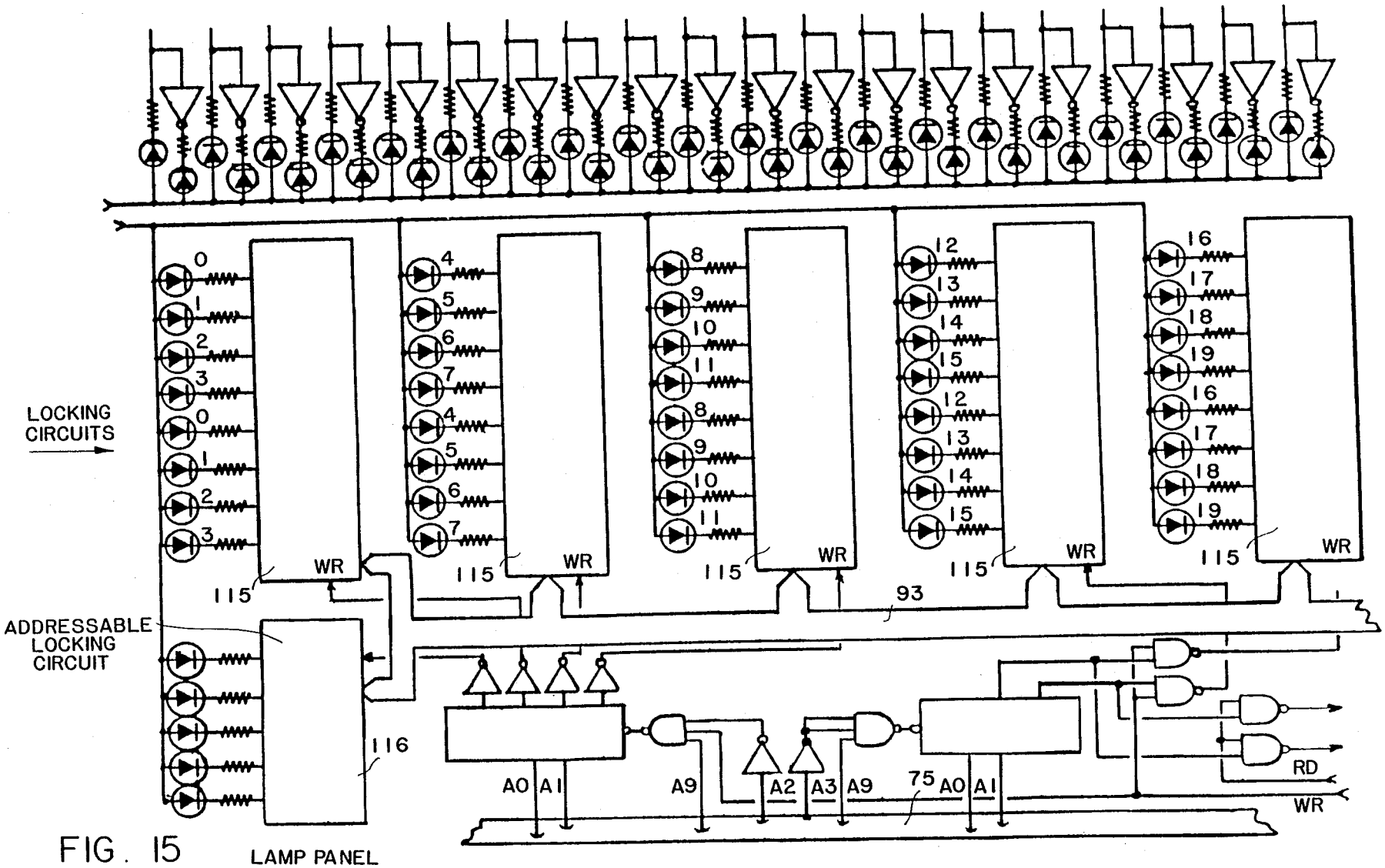
FIG. 15 illustrates the control circuits for the panel lights at the desk.

FIG. 15 illustrates the schematic of the panel lights at the desk which have been described above. We observed that the door state lights corresponding to whether the door is open or closed are directly energized by a relay comprised in the junction and signalling box; buffer amplifiers 114 provide the complementary operation of the two lights "OPEN" and "CLOSED" for each exit.

The panel light included in the exit number key and the panel light signalling the visual state are jointly responsible for an addressable locking circuit 115. Each time a circuit 115 is addressed it can turn on or off one of eight panel lights. The other panel lights may be in any state either on or off; eight successive addressing sequences are thus necessary to obtain the required signalling state of eight panel lights controlled by the circuit 115.

The panel lights incorporated in the function keys are also connected to an addressable locking circuit 116.

In accordance with the invention, we provide a single display apparatus to watch all the exits and the central processing unit is completed by a video processing module which allows the removal of certain areas of the picture on the screen to replace these by lines of text without superposing the picture by the text. We thus have a perfect visibility of the message permanently displayed on the screen made up of for example by a video monitor screen 117. We can for example, as on the screen of 117 of FIG. 16, reserve two lines 118 at the top of the screen for messages concerning the momentary status of an exit and four lines 119 at the bottom of the screen concerning the messages of the waiting exits. The messages are inscribed on the above mentioned lines in the same order as they arrive, that is that the message regarding the last event that occurred is inscribed in the first position on the reserved lines. Thus, in the example represented, it is possible to write four messages regarding the state of an exit in the two lines 118 at the top of the screen and nine messages concerning the exits waiting for processing in the four lines 119 included at the bottom of the screen. The lines 118 and 119 frame one picture area 120.

FIG. 17 illustrates the introduction of video surveillance apparatus. The cameras 121 are grouped into sets of eight and are connected to a video selection component 122 which transmits the video signal of the selected camera to a video processing module 58 which controls the monitor 52.

FIG. 18 gives the schematic of the video selection component which allows the selection of one picture supplied by one of the eight cameras. This component is essentially made up by an eight relay seeker 124, each relay having two working contacts, one guaranteeing the selection of a camera, the other controlling the lighting projector associated with the camera. The eight relays 124 are controlled by an addressable locking circuit 125.

FIG. 19 illustrates the principle of the video processing module. This module has essentially two parts; a circuit to switch pictures for messages and a circuit to elaborate on messages.

In accordance with the invention, the module 123 comprises for the insertion of messages, a synchronization separator 126 which generates the "sync H" and "sync V" signals from the composite signals supplied by a camera. The "sync V" signal at the end of a frame is used to reset to zero the counters of module 123. It is sent to a phase-lock loop stabilized clock 127. The "sync H" signals are sent to the clock input of a line counter 128 whose output is connected to a decoder 129 whose output is connected to the control input of a video switch 130, which at its signal input receives the composite video signal. The switch 130 may be a wide-band analog gate.

Module 123 also comprises a memory 131 associated with logic circuits to allow the reading or writing in ASCII code.

In accordance with the invention, when the microprocessor 63 writes in memory 131, a message display inhibit signal is generated by a logic circuit 132 whose output controls a video mixing amplifier 133 whose output is connected to the input of a video switch 130. As a result this inhibit exists only during the time intervals corresponding to the sweeping of message lines 118 and 119 and it does not effect the display of pictures in the area 120 of monitor 117.

The reading of memory 131 is governed by an address counter 134 which is reset to zero by the "sync V" signal. In this way we achieve perfect synchronization with the camera supplying the pictures. This synchronization is also achieved due to the slaving of clock 127. The input of 134 is connected to the output of a NAND gate whose inputs are connected to the outputs of 129 and 127.

The characters are generated by an appropriate read only memory 136.

The video processing module also comprises three stages of buffer circuits 137 to 139 which make up the interfaces between logic systems employing different technologies.

The exit control system which has been described has a limited capacity, because it has five interface cards with the exits, that is it can supervise twenty exits and two video selection components. Thus, from the twenty exits there are four which are directly watched at the security guard post.

If a greater capacity is required, with regard to the number of exits that can be watched, we can, in accordance with the invention, use a number of apparatus as have been described, each being connected to a master system having a microprocessor working preferably in a high level language such as PASCAL. FIG. 20 illustrates such a system. We see a number of exit control apparatus 140.1 to **140.*n* each having a microprocessor 63, the exit interface cards of FIG. 9, a video selection component 122 and a video processing module 123. We can for example supervise sixteen exit control apparatus with a master system 141 which comprises a microprocessor 142, a bulk memory 143, a video monitor 144 and a control desk. The different microprocessors 63 are connected by a synchronous series link connected to inputs 67 and outputs 68, FIG. 8. The different video selection components are connected to the video monitors 144 of the master system 141. A printer 145** is also provided.

In this case we can inhibit the video monitors and the control desk of the apparatus 140.1 to **140.*n***, or we can purely and simply suppress them since the master supervises all the exits, the messages and pictures being displayed on its video monitors and the control being carried out by its control keyboard.

Advantageously, a hierarchy of the circuits can be provided, this hierarchy being supervised by the microcomputer 142. The master system 141 may also have graphic peripherals and a voice system module for the communication of messages.

The operation of the apparatus which has been described is the following.

As soon as a person activates an anti-panic bar, a visual and eventually a sound signal is generated at the exit concerned. This indicates to a person that there will be a delay to the opening and that its request has been registered. At the security guard post, a sound alarm alerts the security guard and a message appears on the screen in the video lines under the form "DOOR AT REQUEST". In other respects, on the control desk, the number key corresponding to the exit flashes as well as the VISU and VIGIL function keys.

The security guard thus has the choice of two possibilities; he does not intervene and in this case the operation is automatic, that is at the end of a short delay for example 8 seconds, the exit concerned is unlocked which suppresses the sound alarm, replaces the message on the screen by the message "DOOR XX OPEN". In other respects, the door number key panel light and the function key panel lights VISU and VIGIL turn off and the state panel light of the exit considered goes from CLOSED to the OPEN. At the level of the exit considered, the sound and light alarms also cease.

At the end of a much longer time delay, for example 1 minute, another sound alarm is generated at the security guard post and the new message is "REARM DOOR XX", the number key of the corresponding exit flashes, the rearm function key flashes. The security guard must then rearm the exit, that is he successively pushes on the key of the exit considered and then on the functiOn key rearm. The message on the screen "DOOR XX CLOSED" and the number keys of the exit of concern and the function key REARM stop flashing; in other respects, the state panel light goes from "OPEN" to "CLOSED".

The second possibility is that in this case the security guard intervenes, during the first 8 second time delay, he must observe directly either visually or on the monitor what is happening at the exit concerned. If the door is not in direct line of sight with the security guard post, the security guard presses on the VISU function key, the panel light of this key goes to steady on, the sound alarm stops, the message on the video screen becomes "CAMERA DOOR XX" and the picture supplied by the concerned camera appears in area 120 of the video screen.

At this point, the security guard has two choices. He may decide not to intervene any further and let the normal cycle run out, that is at the end of the first time delay, the exit is unlocked. However, the security guard may also push on the number key for the exit concerned. On the lower line of the creeen the message "VIGIL DOOR XX" then appears. The visual and sound alarms for the exit considered continue, however, their rate changes to become slower. In other respects, if the exit is provided with a projector, it is turned on. All this indicates to the person which has requested the opening that they are being attended to. This initiates another and even longer third time delay, for example for 3 minutes, at the end of which the exit is unlocked and the request to rearm the system is immediately sent to the security guard.

All operations triggering an action at the door are controlled first by the number key of the exit considered, then by the desired function key.

We observe that the invention allows the security guard to intervene very quickly and to become aware of what is happening at the exit from which a request was sent, given that there is only a single screen to watch. As soon as a request intervenes, the security guard may press on the number key of the corresponding exit and the VISU request, and he immediately obtains the picture of what is happening at the exit. This procedure is quick and can be carried out without difficulty during the course of the 8 second delay.

In other respects, the fact of using a single video monitor and a single control desk, the apparatus allows the realization of a low cost apparatus. In the case of an installation comprising a large number of exits, it is possible to use a large number of exit control apparatus controlled by a master system which can in other respects carry the classical watch functions such as the surveillance of parking lots.

To verify the rearm state of a door, we provide a micro-contact in the door frame which is only closed when the door is correctly and completely shut. We thus avoid situations where a door is improperly closed because an object has remained across it. The micro-contact may be in the fault loop.

In other respects, instead of a conventional panic bar, we can provide the exits with electric bars which, when they are activated do not open a lock, but electro-magnets through contacts. Of course, the apparatus of the invention is inserted between the micro-contact and the electro-magnets.

I claim:

1. A process to control emergency exits in a building comprising at least a security guard post, each emergency exit being provided with an unlocking component, means responsive to an activation of the unlocking component for opening the emergency exit for generating an interrogation signal which initiates a request for information from the security guard post, means responsive to said interrogation signal for setting off a first time delay To during which the security guard may forbid the opening of the exit of concern during a second time delay Tc, means for normally opening the exit at the end of the first time delay To in the absence of guard intervention, and means responsive to an intervention by the security guard for delaying the opening until the end of the second time delay Tc.

2. A process in accordance with claim 1, and means responsive to an activation of the unlocking component for opening an emergency exit which also operates a visual indicator at the exit considered.

3. A process in accordance with claim 1 and means responsive to a non-intervention by the security guard for initiating a third delay Tf at the end of the first time delay To, means responsive to an end of said third delay Tf for sending an authorization to bar the opening of the door to the security guard post, and means responsive to an intervention by the security guard and responsive to the opening of the exit for triggering a transmission of a signal to bar the opening of the door, said signal being transmitted to the security guard post.

4. An apparatus to carry out the process in accordance with claim 1 wherein the exit is provided with an unlocking component such as an anti-panic bar, means comprising an electro-mechanical lock for blocking the unlocking component, a sensor which is sensitive to motion of the unlocking component, a command and control line linking each exit to be controlled by the security guard post and an electronic system at the security guard post and a sensor surveillance circuit, and a security circuit which frees the unlocking component at the appearance of a fault.

5. An apparatus in accordance with claim 4, and a signalling apparatus at each exit.

6. An apparatus in accordance with claim 4 wherein the security circuit comprises a "watch dog" circuit.

7. An apparatus in accordance with claim 4 wherein the electromechanical system has a control and signalling panel.

8. An apparatus in accordance with claim 4 wherein the sensor for the unlocking conponent at each exit is made up of microswitches.

9. An apparatus in accordance with claim 8, wherein the sensor surveillance circuit includes a detection loop supplied by a direct current and resistors connected in parallel with the microswitches.

10. An apparatus in accordance with claim 9 wherein the loop is part of an accident detection circuit device in the lock supply circuit.

11. An apparatus for the control of exits provided with an unlocking component such as an anti-panic bar, of the type having an electro-mechanical apparatus for blocking the unlocking component, a sensor which is sensitive to motion of the unlocking component, a command and control line connecting each of the exits which are to be controlled to a security guard post, and an electronic system located at the security guard post and having a sensor surveillance circuit, said electronic system being connected to said command and control line, a security switch which frees the unlocking component when a fault appears, surveillance camera means at each of the exits which is located out of sight of the security guard post, an electronic system having a display apparatus connected to the different cameras via a video selection component, said display apparatus uniquely identifying the camera giving a picture as it is being displayed, and means responsive to a reception of a request signal from a sensor associated with an exit for enabling a security guard to select the picture being supplied by the camera surveilling the exit.

12. An apparatus to control exits in accordance with claim 10, and means comprising a video processing module for suppressing certain areas of the pictures and replacing the suppressed areas without superposition by messages.

13. An apparatus to control exits in accordance with claim 12, wherein the video processing module includes circuit means for separating the horizontal and vertical synchronization signals supplied by the selected camera, a horizontal line counter, and a video switch for selecting either the picture from the selected camera or the messages.

14. An apparatus to control exits, in accordance with claim 11 and keyboard means in said electronic system comprising an unique keyboard for each exit to be controlled by a selection key operation, and a panel light having lights to indicate the states of the individual exits and control keys.

15. An apparatus to control exits in accordance with claim 12 characterized in that the messages displayed on the display apparatus are made up of all of the messages concerning the requests and the interventions concerning all the exits to be watched.

16. An apparatus to control exits in accordance with claim 11 and a projector associated with each camera, said projector being turned on when the associated camera is selected by the video selection component.

17. An apparatus to control exits in accordance with claim 13 wherein the vertical synchronization signal is used for synchronizing the elements of the video processing module and for resetting the horizontal line counter to zero.

18. A group of apparatus to control exits in accordance with claim 11 characterized in that said exit apparatus are connected to a central processor through a data transmission line, said central processor surveilling and controlling a group of exit control apparatus and having a display apparatus and a central control keyboard.

19. A system in accordance with claim 18, characterized in that the central processor comprises graphic display and voice sensor means.

20. A system in accordance with claim 18 and means in the central processor for processing the different exits in a hierarchical manner.

* * * * *

UNITED STATES PATENT AND TRADEMARK OFFICE

CERTIFICATE OF CORRECTION

PATENT NO. : 4,652,862

DATED : March 24, 1987

INVENTOR(S) : Alain R. Verslycken

It is certified that error appears in the above-identified patent and that said Letters Patent is hereby corrected as shown below:

IN THE TITLE:

Change "EXISTS" to --EXITS--.

Signed and Sealed this

Eleventh Day of August, 1987

*Attest:*

DONALD J. QUIGG

*Attesting Officer*

*Commissioner of Patents and Trademarks*